US011015270B2

(12) United States Patent
Lonati et al.

(10) Patent No.: US 11,015,270 B2
(45) Date of Patent: May 25, 2021

(54) TURNING DEVICE FOR KNITTED TUBULAR ARTICLES, PARTICULARLY FOR TURNING INSIDE-OUT TUBULAR ARTICLES WITH POCKETS THAT PROTRUDE FROM THE LATERAL SURFACE THEREOF

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 6 days.

(21) Appl. No.: 15/774,447

(22) PCT Filed: Nov. 2, 2016

(86) PCT No.: PCT/EP2016/076450
§ 371 (c)(1),
(2) Date: May 8, 2018

(87) PCT Pub. No.: WO2017/080890
PCT Pub. Date: May 18, 2017

(65) Prior Publication Data

US 2018/0327944 A1 Nov. 15, 2018

(30) Foreign Application Priority Data

Nov. 10, 2015 (IT) ..... 102015000070695

(51) Int. Cl.
*D04B 9/40* (2006.01)
*D04B 15/92* (2006.01)
(Continued)

(52) U.S. Cl.
CPC ..... *D04B 9/40* (2013.01); *D04B 15/92* (2013.01); *D05B 23/009* (2013.01); *D06G 3/02* (2013.01)

(58) Field of Classification Search
CPC ..... D04B 9/40; D04B 15/88; D04B 15/92; D06G 3/00; D06G 3/02; D06G 3/04; D05B 23/009
(Continued)

(56) References Cited

U.S. PATENT DOCUMENTS 7,975,513 B2 * 7/2011 Lonati ..... D04B 15/92 66/148
9,481,952 B2 11/2016 Lonati et al.
(Continued)

FOREIGN PATENT DOCUMENTS

CN 102203335 9/2011
CN 103917706 9/2014
(Continued)

OTHER PUBLICATIONS

Korean Office Action related to Application No. 10-2018-7008060, dated Jun. 14, 2019 (4pgs.).
(Continued)

*Primary Examiner* — Danny Worrell
*Assistant Examiner* — Aiying Zhao
(74) *Attorney, Agent, or Firm* — Husch Blackwell LLP

(57) ABSTRACT

A turning device for knitted tubular articles, particularly for turning inside-out tubular articles with pockets that protrude from the lateral surface thereof. The turning device in question comprises a main supporting structure which supports a tubular body arranged with its axis substantially vertical. The tubular body has its upper axial end beveled along a plane that is inclined with respect to its axis. The turning device comprises first actuation means which can be
(Continued)

Figure 1:
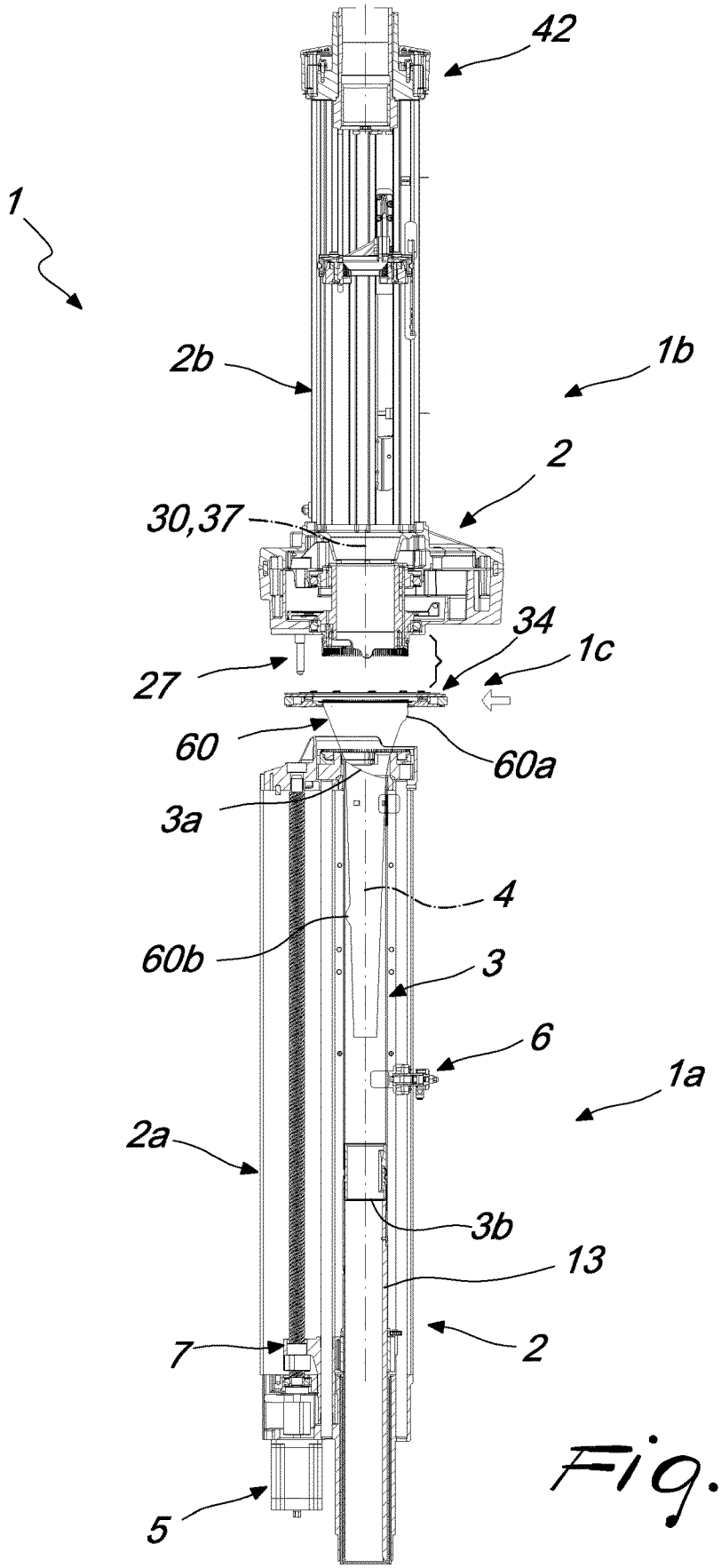

activated to perform a translation of the tubular body along its axis with respect to the main supporting structure. The tubular body is insertable, with its upper axial end, through an axial end of a tubular article in order to turn it inside out. The turning device comprises second actuation means which can be activated to rotate the tubular body about its own axis, through an angle of preset breadth, with respect to the main supporting structure.

11 Claims, 26 Drawing Sheets

(51) Int. Cl.
*D06G 3/02* (2006.01)
*D05B 23/00* (2006.01)

(58) Field of Classification Search
USPC ..... 66/148, 149 R
See application file for complete search history.

(56) References Cited

U.S. PATENT DOCUMENTS

| | | | | |
|---|---|---|---|---|
| 9,683,321 | B2 | 6/2017 | Lonati et al. | |
| 2003/0233852 | A1 | 12/2003 | Lonati et al. | |
| 2010/0313608 | A1* | 12/2010 | Lonati | D04B 15/92 66/149 S |
| 2010/0319410 | A1 | 12/2010 | Bianchi | |
| 2017/0130549 | A1* | 5/2017 | Kroesen | E21B 33/063 |

FOREIGN PATENT DOCUMENTS

| | | | |
|---|---|---|---|
| CN | 104514077 | | 4/2015 |
| EP | 2250307 | | 11/2010 |
| JP | 2005097803 | | 4/2005 |
| JP | 2005105421 | | 4/2005 |
| JP | 2005105421 | A * | 4/2005 |
| KR | 20100127221 | | 12/2010 |
| WO | 2009112348 | | 9/2009 |
| WO | WO14/111206 | | 7/2014 |

OTHER PUBLICATIONS

English Summary of Korean Office Action related to Application No. 10-2018-7008060, dated Jun. 14, 2019 (3pgs.).
Chinese Office Action related to Application No. 201680064093.1, dated Jun. 27, 2019 (6 pgs.).
English translation from the China Patent Office of Chinese Office Action related to Application No. 201680064093.1, dated Jun. 27, 2019 (6 pgs.).
Italian Search Report and Written Opinion from IT UB20155413.
English Summary of Columbian Office Action No. 8639 regarding Columbian Patent Application No. NC2018/0002205, dated Sep. 26, 2019 (7 pgs.).
Office Action dated Oct. 22, 2020 for Japanese Patent Application Serial No. 2018-521557.
Examination report from corresponding in application 201837006566, dated Mar. 10, 2021.

* cited by examiner

TURNING DEVICE FOR KNITTED TUBULAR ARTICLES, PARTICULARLY FOR TURNING INSIDE-OUT TUBULAR ARTICLES WITH POCKETS THAT PROTRUDE FROM THE LATERAL SURFACE THEREOF

The present invention relates to a turning device for knitted tubular articles, particularly for turning inside-out tubular articles with pockets that protrude from the lateral surface thereof. The device in question, although it can be used more generally in any processing that requires the inversion of tubular articles, has been devised particularly for turning tubular articles in sewing or linking stations for the automated closure of tubular articles at an axial end thereof, for example for the automated closure of the toe of socks.

Techniques are known for executing the automated closure of knitted tubular articles, in particular socks, at an axial end thereof at the end of their production on circular machines for knitting or hosiery.

Some of these techniques are based on picking up the article, at the end of its production, from the circular hosiery or knitting machine and on transferring it to a linking or sewing station, which is generally arranged beside the machine used to produce the article.

In the linking or sewing station, there is a linking or sewing head with which the closure is carried out of the axial end of the article, which usually is constituted by the axial end at which production of the article ended.

Some techniques are based on using a single device both to pick up the article from the machine that produced it and to support the article during the sewing or linking operation to close its axial end. In other techniques, there is a device to pick up the article and transfer it to the linking or sewing station, and there is a handling device which is arranged in the linking or sewing station and is used to prepare the article for the subsequent operation of sewing or linking, and optionally to move the article during the sewing or linking with respect to the linking or sewing head.

Usually, picking up the article from the machine that produced it and optionally transferring it to the handling device are done by individually engaging the loops of knitting of the last row of knitting formed of the article, and the loops of knitting of one half-row of such last row of knitting are individually faced toward the loops of knitting of the other half-row, before proceeding with the sewing or linking so that the closure of the axial end of the article is carried out by joining, in each instance, two mutually facing loops of the two half-rows that make up the last row of knitting formed. By virtue of this fact, an excellent result in terms of precision and appearance is obtained in the automated closure of axial ends of knitted tubular articles, in particular socks.

In both of these techniques, very often, the sewing or linking operation is carried out on the article in the inside-out configuration so that the sewing or linking chain is not easily visible on the external side of the article and that is to say on the side that, usually, is visible with the article being worn.

For this reason, in sewing or linking stations intended to implement these techniques for closing one axial end of knitted tubular articles, a turning device is generally provided the function of which is to perform the inside-out turning of the article, which is taken in the right-way-out configuration from the machine that produced it, before subjecting it to the sewing or linking operation and optionally turning it again in order to bring it to the right-way-out configuration after the sewing or linking operation.

One of the most widespread types of turners for this type of use is based on using a tubular body which, from below, faces the article, which is held by a pickup device or by a handling device at its axial end to be closed and is arranged substantially vertically with such axial end directed upward. The tubular body is also arranged with its axis vertical, so as to face the hung article with its upper axial end. The inside of the tubular body is therefore connected to suction means so as to suck, through its upper axial end, the article which however remains retained, at its axial end to be closed, by the pickup device or by the handling device. The tubular body is then lifted so that its upper axial end passes through the axial end of the article which is engaged with the pickup device or with the handling device. As a consequence of this passing through, the article is extroverted on the outer lateral surface of the tubular body and is extracted progressively from the upper axial end of the tubular body by carrying out its inside-out turning.

An inverting device of this type is shown, for example, in European patent EP 2,250,307 B1.

In order to facilitate the operation of inserting the tubular body through the axial end of the article engaged with the pickup device or with the handling device, and in order to facilitate the eversion of the article on the lateral surface of the tubular body, the upper axial end of the tubular body is generally beveled according to an inclined plane, inclined with respect to the axis of the tubular body.

As is known, the semi-finished blanks for providing socks, i.e. the articles that are dispensed from the circular production machine before the closure of the toe or axial end thereof, generally have two pockets that protrude from the lateral surface thereof and which constitute the heel of the sock and the toe cap proximate to which the sewing or linking is executed in order to perform the closure of the toe.

In order to prevent the beveled upper axial end of the tubular body from interfering with these protruding pockets during the operation to turn the article inside out, the tubular body is positioned about its own axis so that the tip of the bevel affects the half of the lateral surface of the article which does not have pockets.

In the majority of cases, in fact, the heel and the toe cap are arranged on a same side of the lateral surface of the tubular article. More precisely, in the majority of cases, the heel and the toe cap are arranged on a same half of the lateral surface of the tubular article. This arrangement exists in socks in which it is intended that the sewing or the linking be on the upper side of the foot of the sock.

In some cases, however, it is intended that the sewing or the linking be on the lower side of the foot of the sock. In these cases, the toe cap is arranged on the opposite half of the lateral surface of the tubular article with respect to the half on which the heel is arranged.

In these cases, during the operation to turn the article in preparation for sewing or linking for the closure of the toe cap, there can be an unwanted sticking of the tip of the bevel of the upper axial end of the tubular body of the turner inside one or the other of these pockets, depending on the orientation of the tubular body about its own axis. The sticking of the tubular body in one of these pockets can cause, during the inversion, damage to, or even the breakage of, the article.

The aim of the present invention is to solve the above mentioned drawback, by providing a turning device for knitted tubular articles, particularly for turning inside-out tubular articles with pockets that protrude from the lateral surface thereof, which effectively prevents a sticking of the beveled end of the tubular body in the pockets of the tubular article subjected to inversion.

Within this aim, an object of the invention is to provide a turning device that can carry out the correct inversion both of tubular articles that have pockets turning inside-out on a same side of the lateral surface thereof and of tubular articles in which the pockets are arranged on two opposite sides of the lateral surface thereof, while avoiding damage thereto.

Another object of the invention is to provide a turning device that can be provided, with modifications that are simple to carry out, from conventional turning devices.

A further object of the invention is to provide a turning device that, by preventing unwanted sticking of the tubular body in the pockets of the article, prevents unwanted interruptions in the production cycle of the articles.

This aim and these and other objects which will become better apparent hereinafter are achieved by a turning device for knitted tubular articles, particularly for turning inside-out tubular articles with pockets that protrude from the lateral surface thereof, which comprises a main supporting structure which supports a tubular body arranged with its axis substantially vertical, said tubular body having its upper axial end beveled along a plane that is inclined with respect to its axis, first actuation means being provided which can be activated to perform a translation of said tubular body along its own axis with respect to said main supporting structure, said tubular body being insertable, with its upper axial end, through an axial end of a tubular article in order to turn it inside out, characterized in that it comprises second actuation means which can be activated to rotate said tubular body about its own axis, through an angle of preset breadth, with respect to said main supporting structure.

Figure 1A:
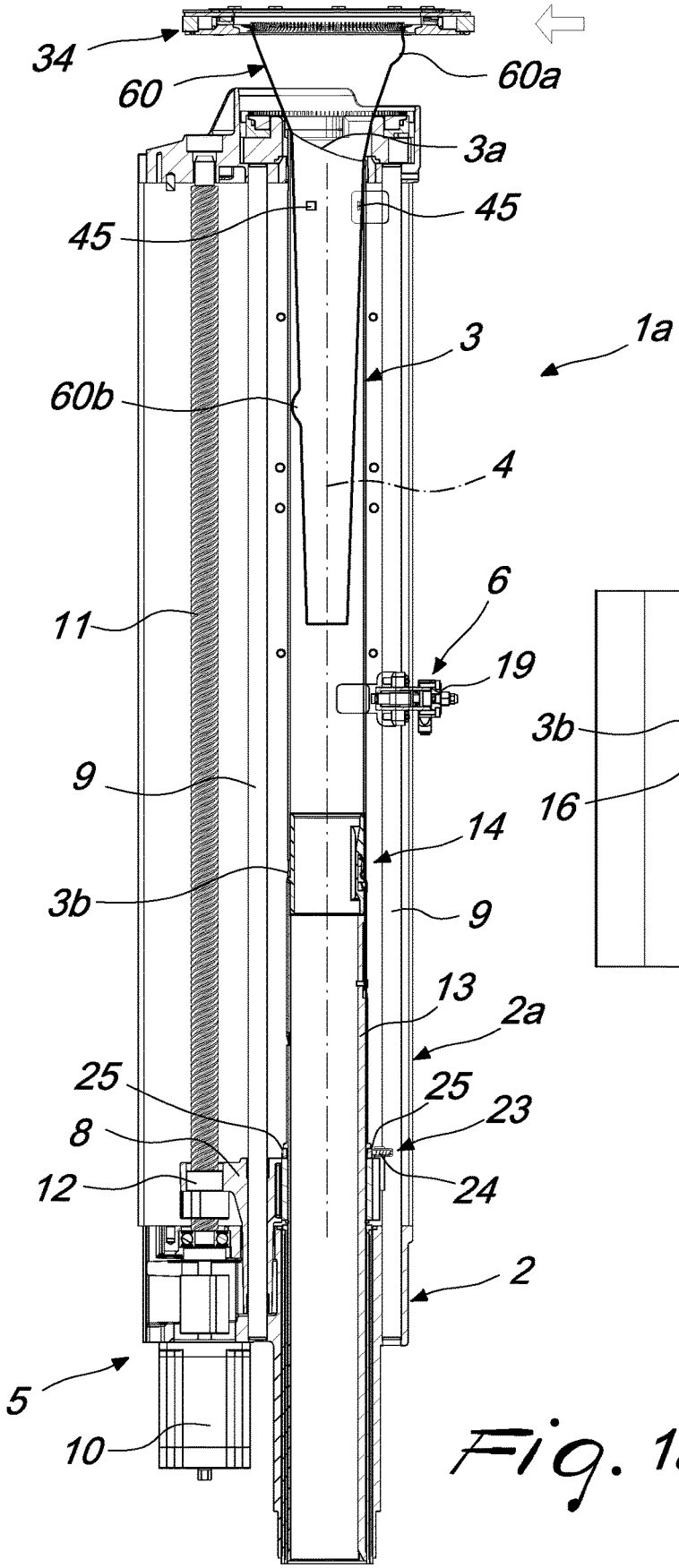
Figure 1B:
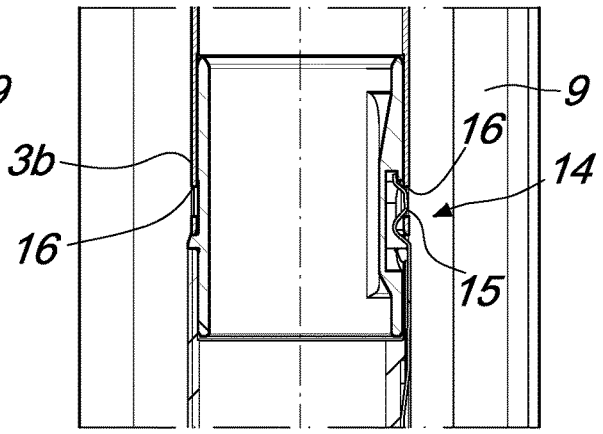

Further characteristics and advantages of the invention will become better apparent from the description of a preferred, but not exclusive, embodiment of the turning device according to the invention, which is illustrated by way of non-limiting example in the accompanying drawings wherein:

FIGS. 1 to 8 are schematic axial cross-sectional views of the turning device according to the invention, arranged at a linking or sewing station, during the various steps of turning inside-out a tubular article, and more specifically:

FIG. 1 schematically illustrates the turning device according to the invention during the operation to position the article at the linking or sewing station and during the suction of the article through the upper axial end of the tubular body of the turning device;

FIG. 1*a* is an enlarged portion of FIG. 1;

FIG. 1*b* is a further enlarged detail of FIG. 1*a;*

Figure 1C:
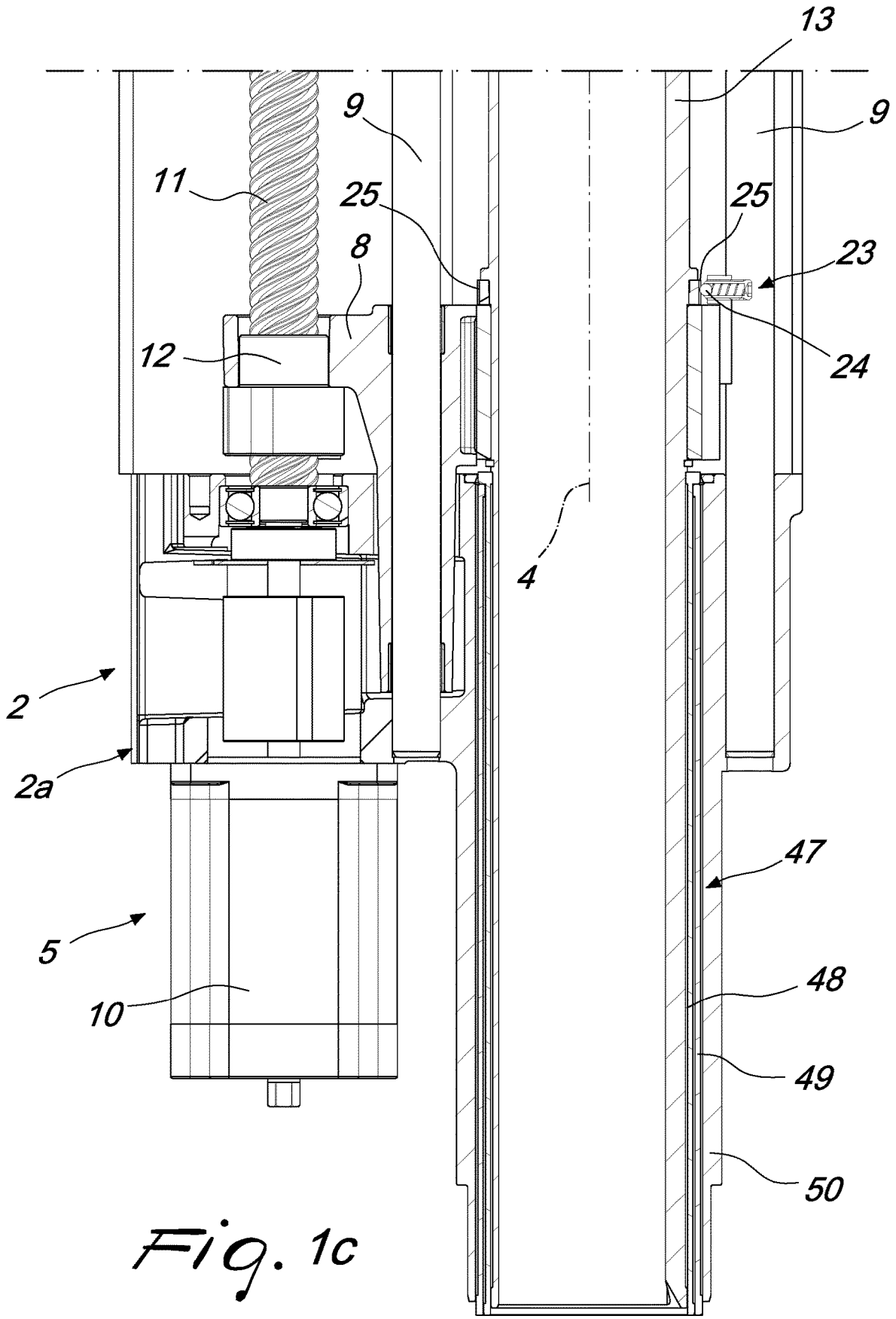

FIG. 1*c* is another further enlarged detail of FIG. 1*a;*

Figure 1D:
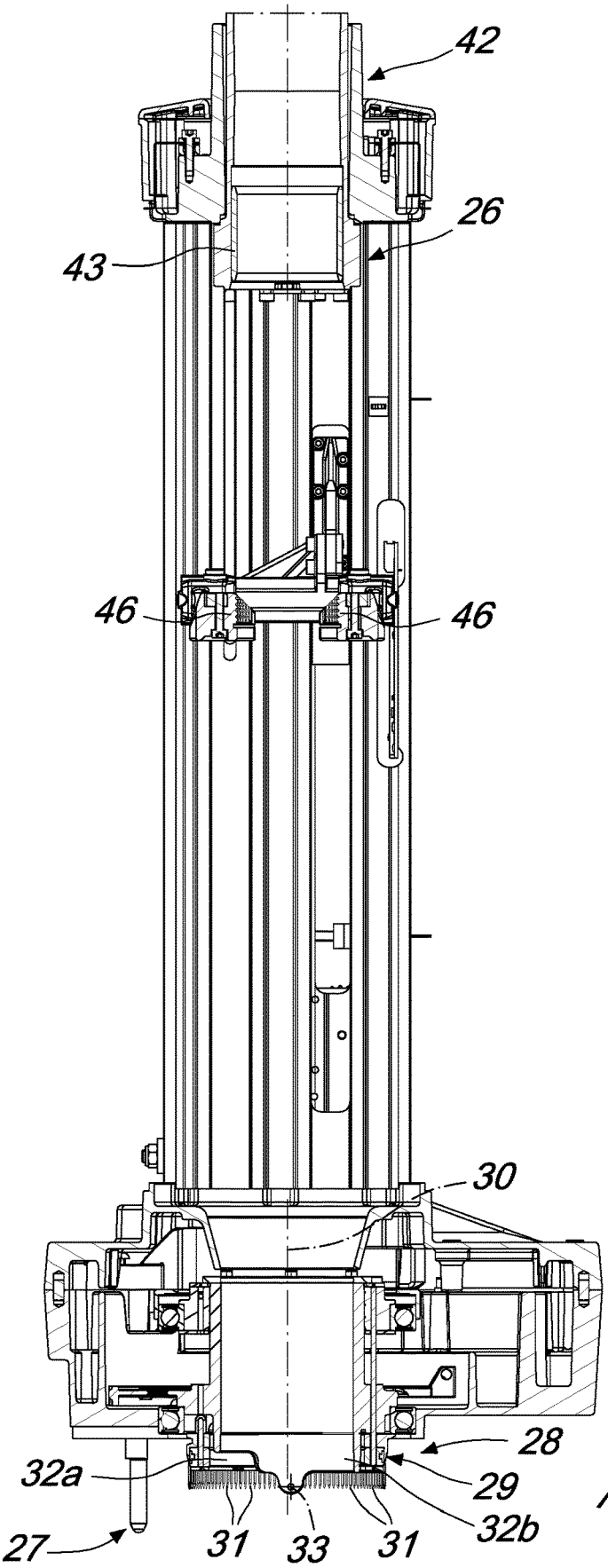
Figure 2:
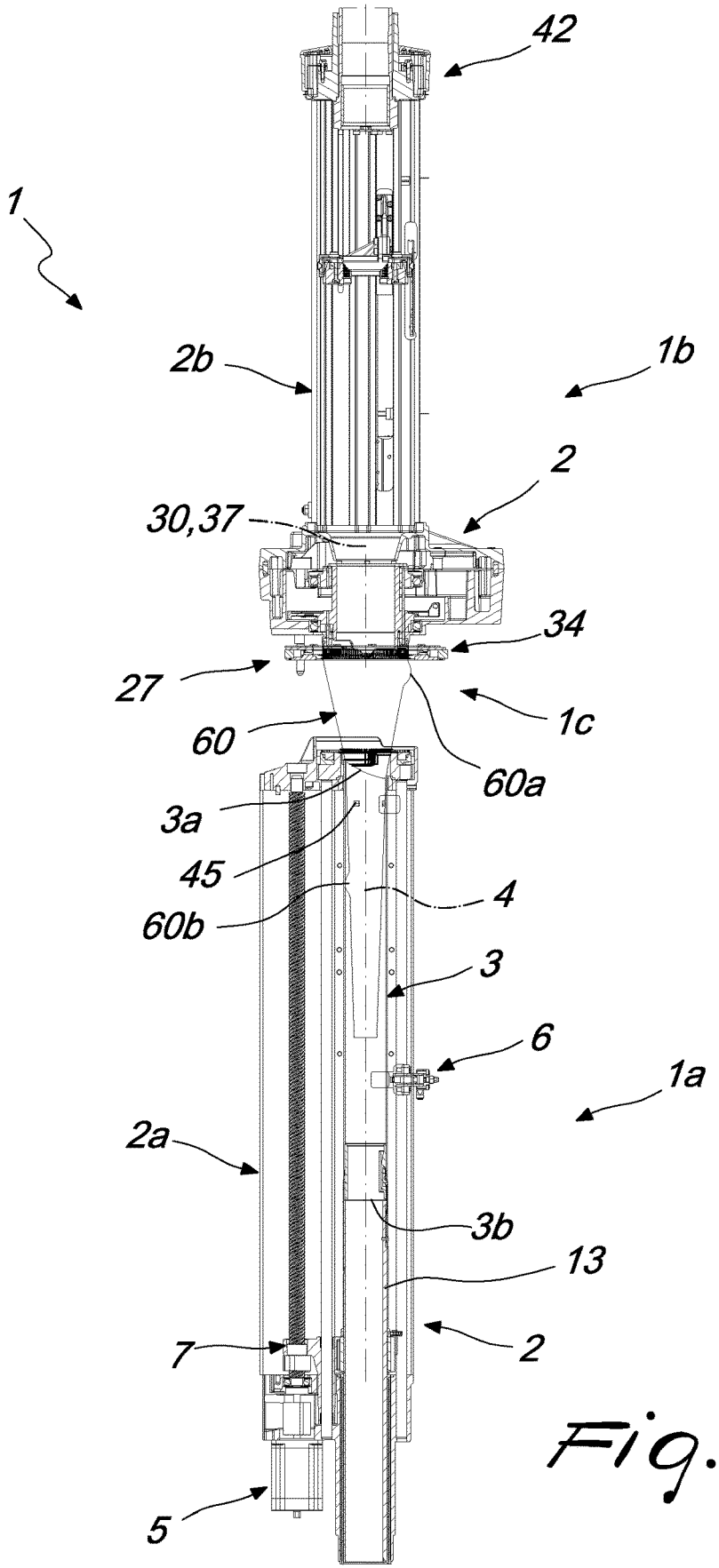
Figure 2A:
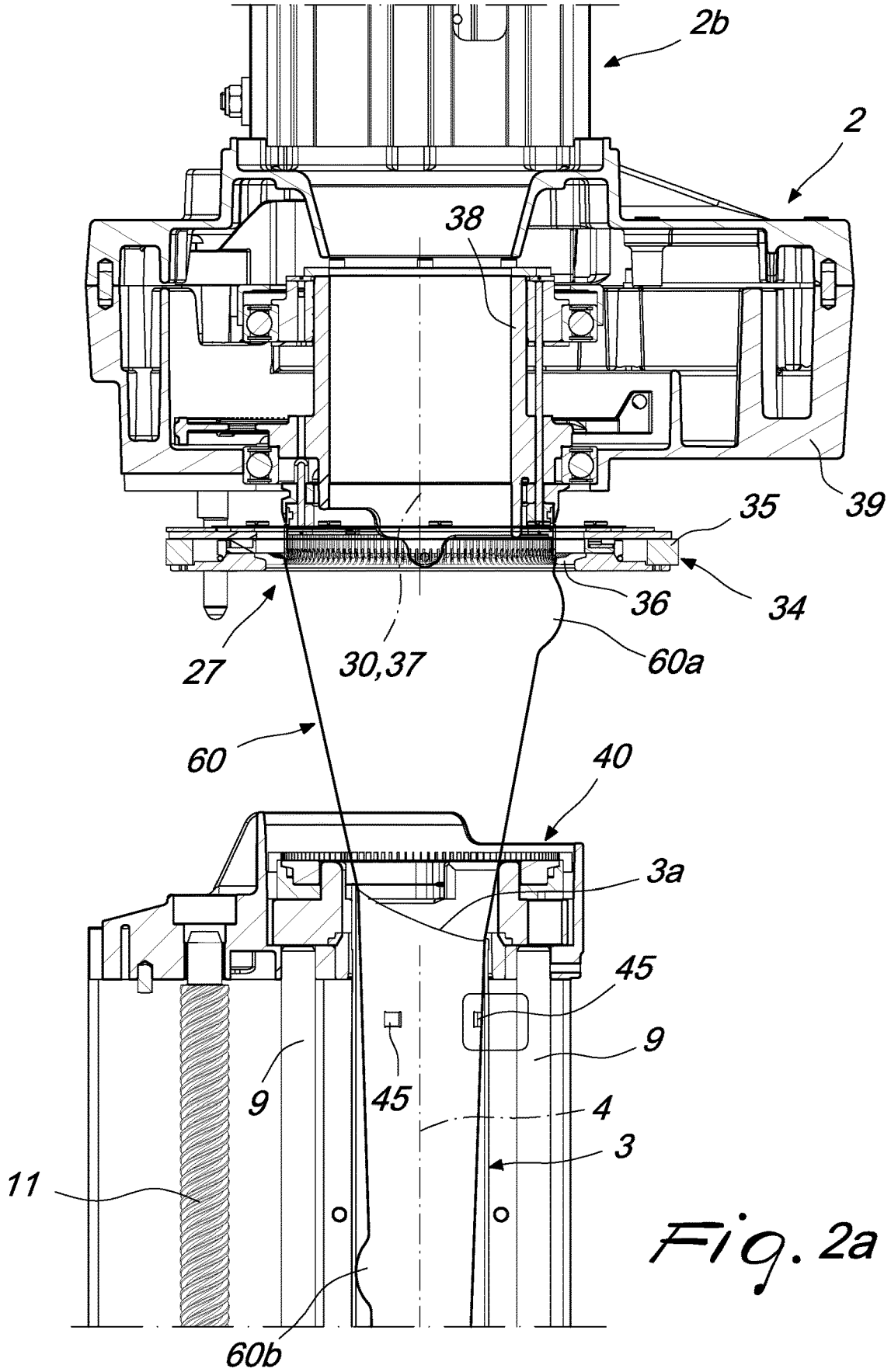
Figure 3:
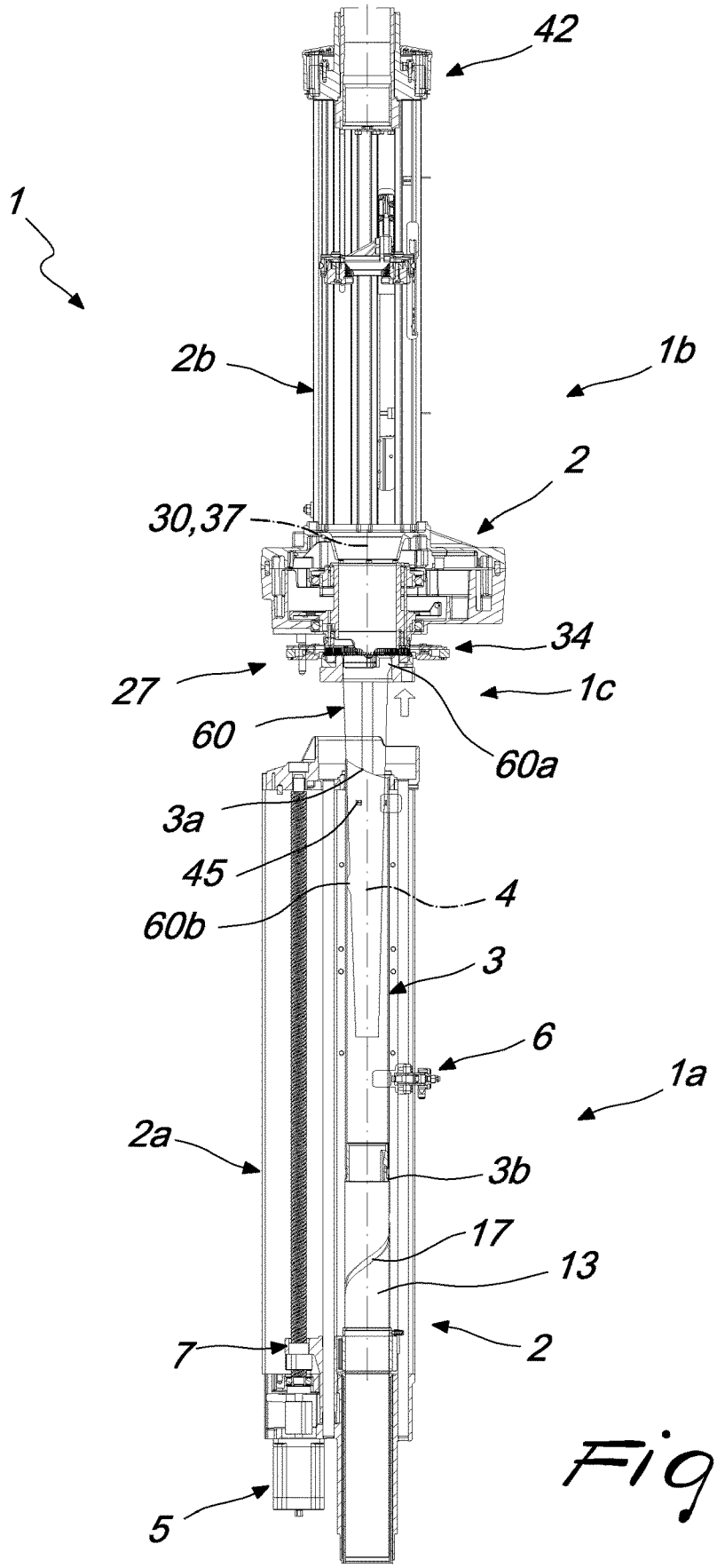
Figure 3A:
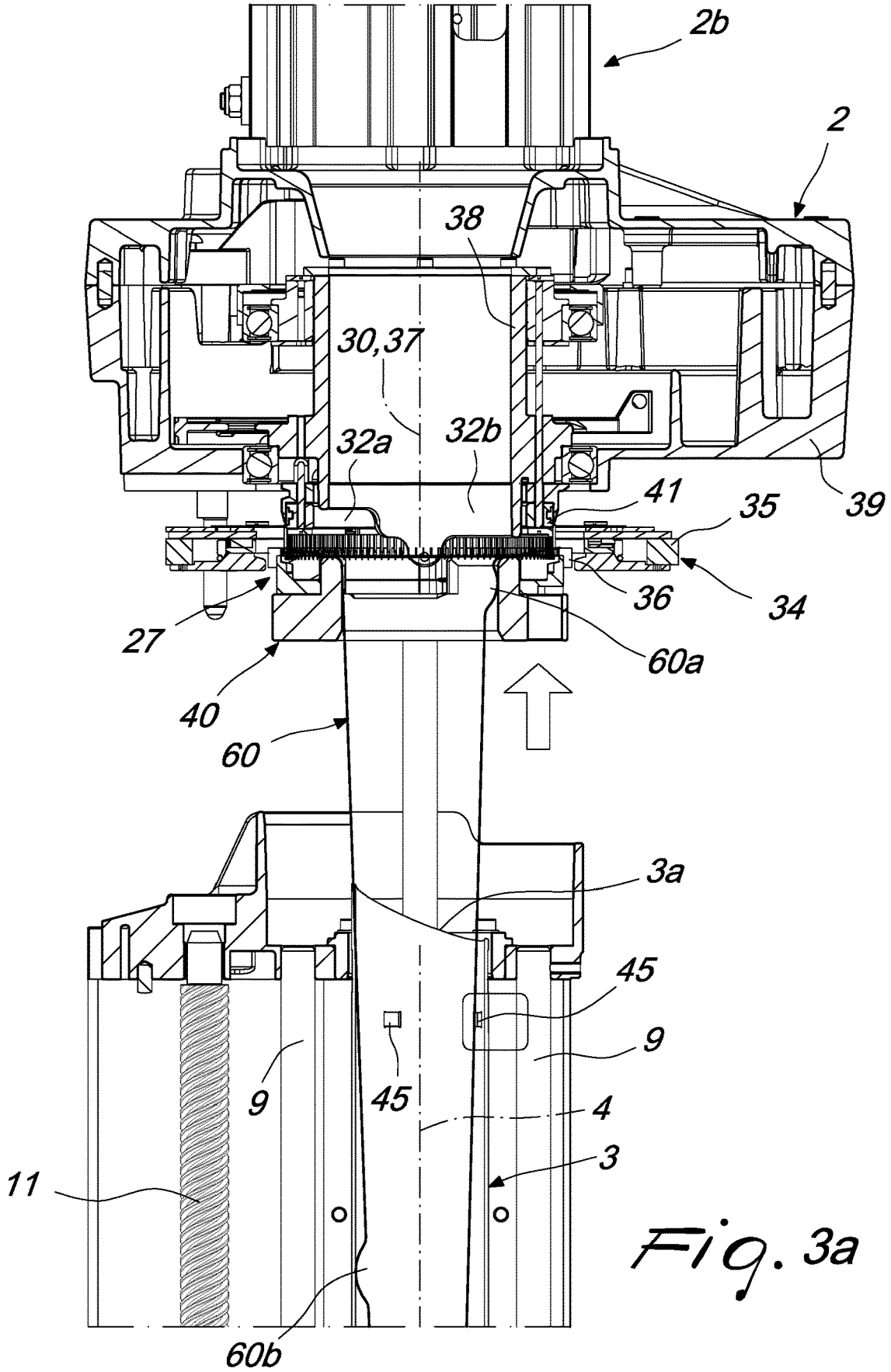
Figure 4:
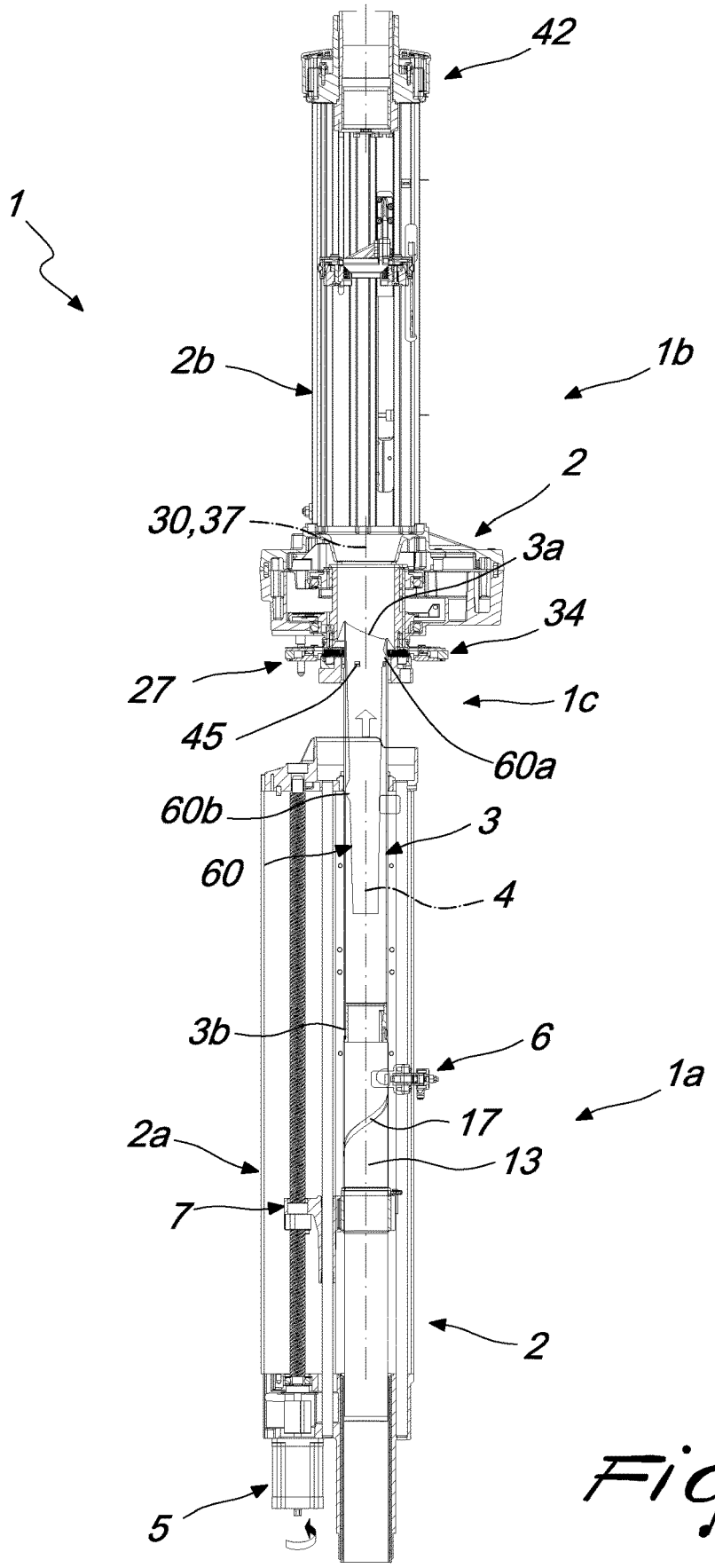
Figure 4A:
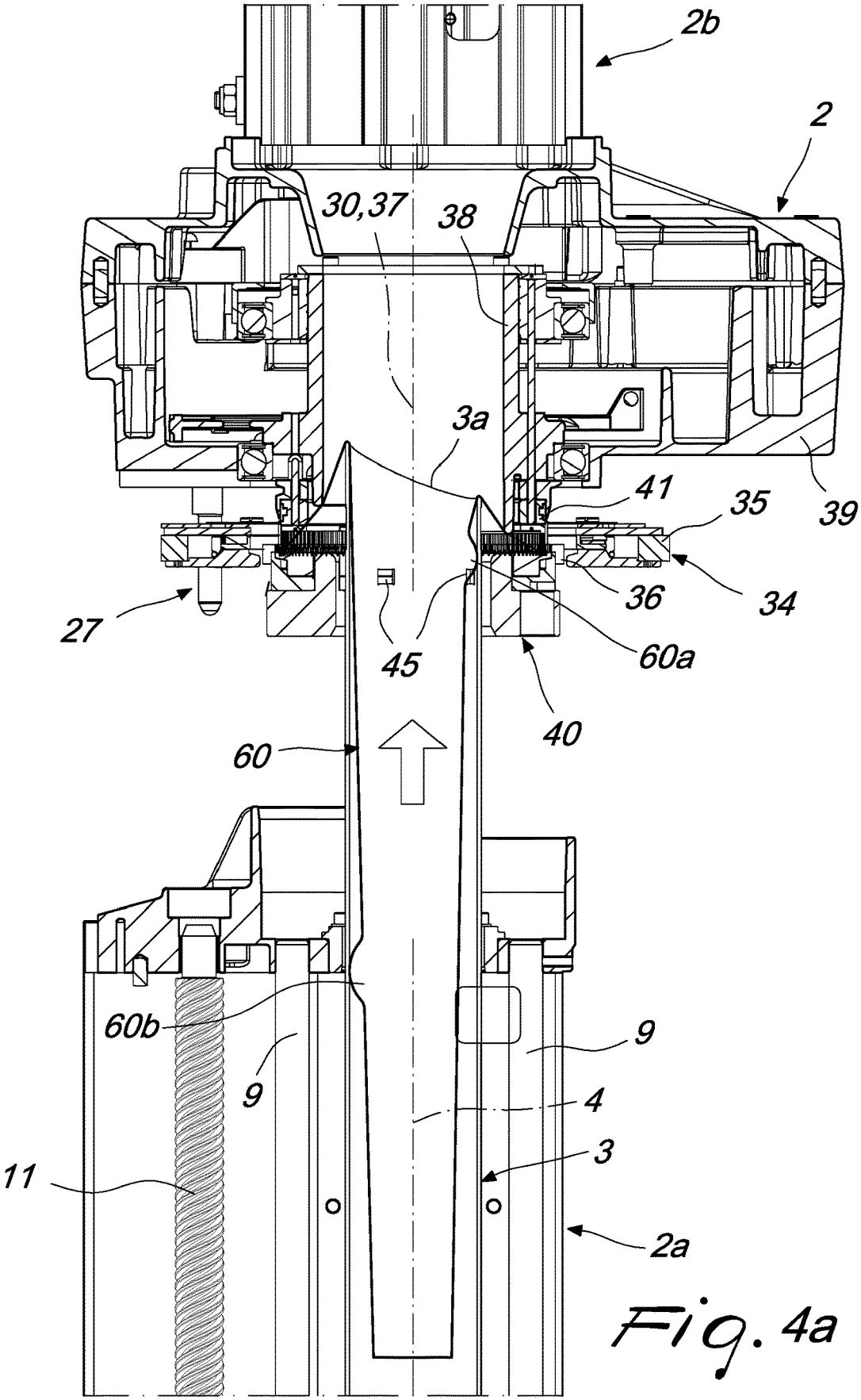
Figure 4B:
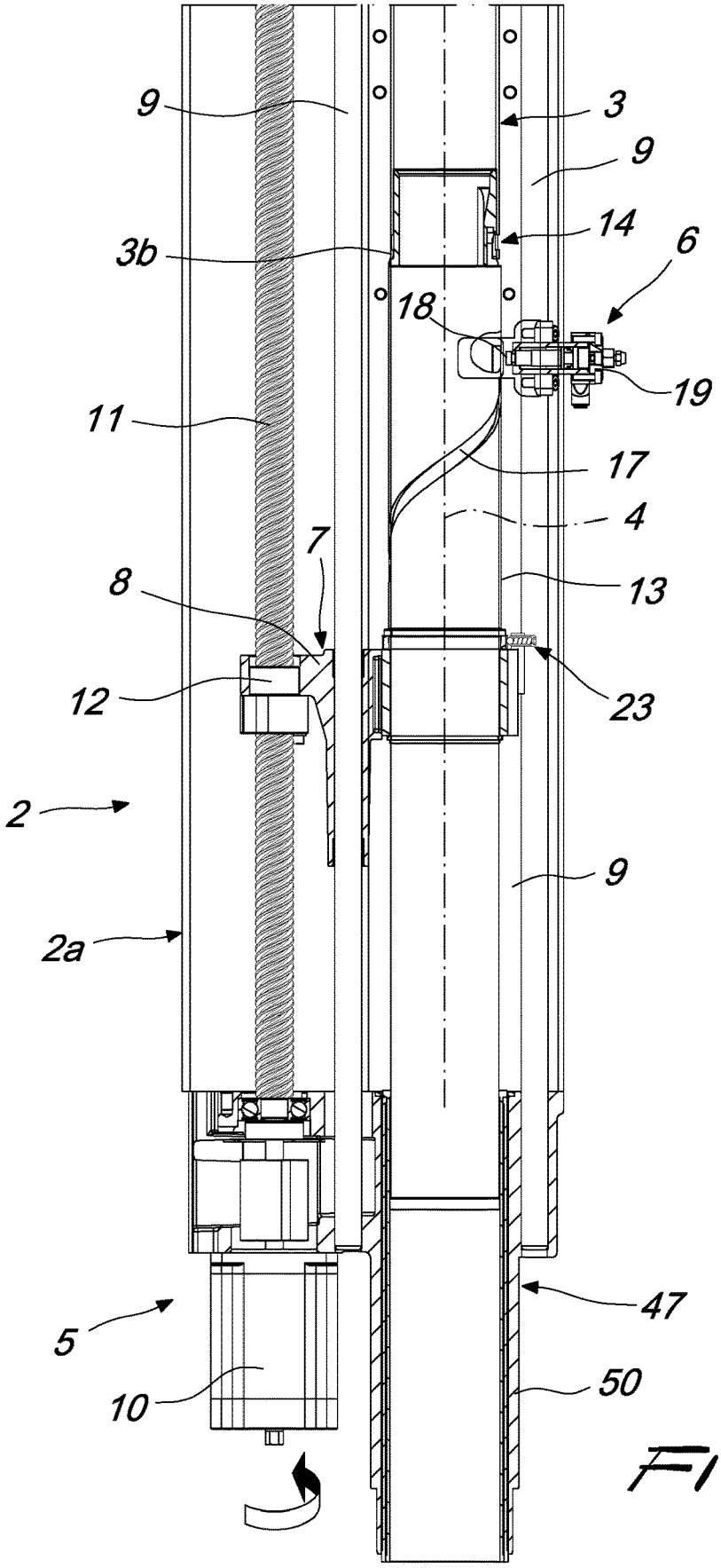
Figure 5:
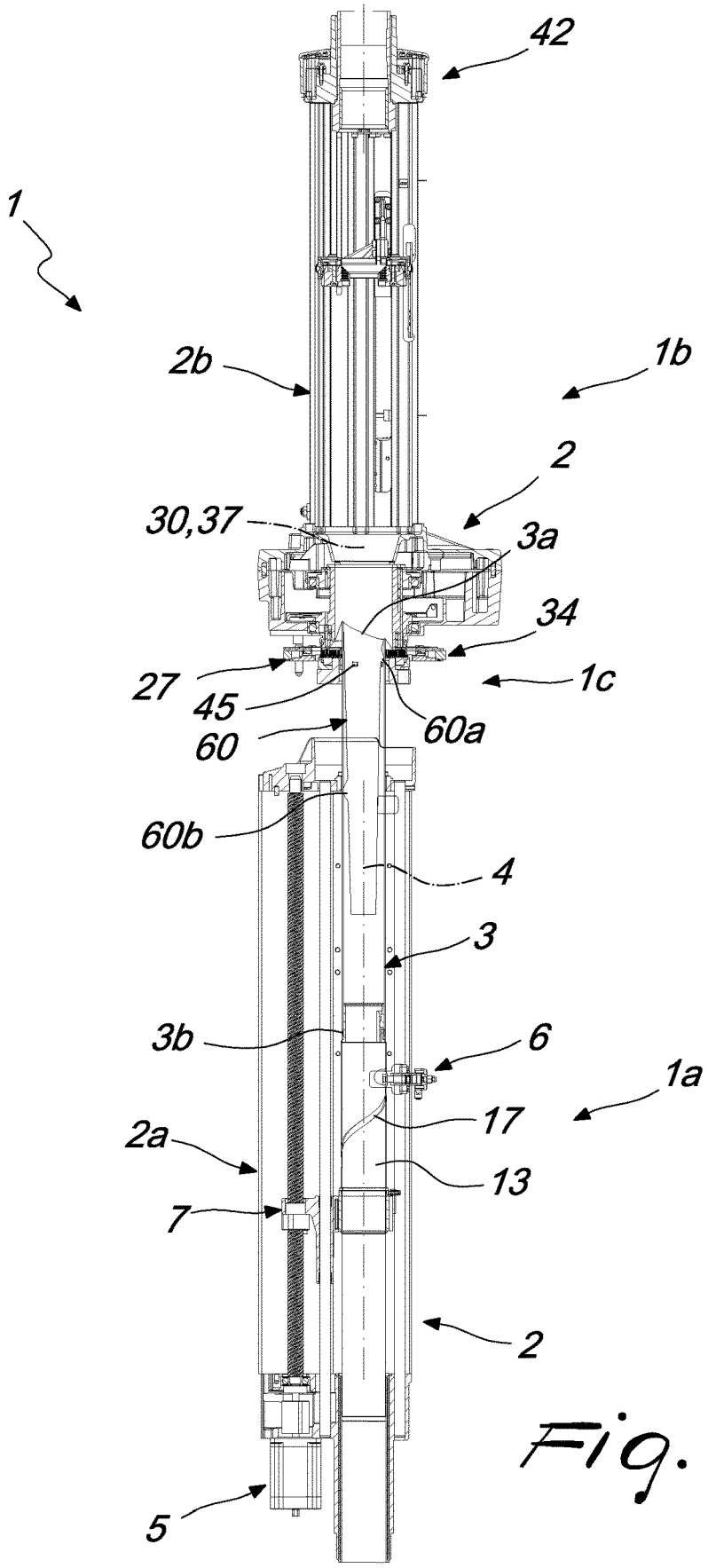
Figure 5A:
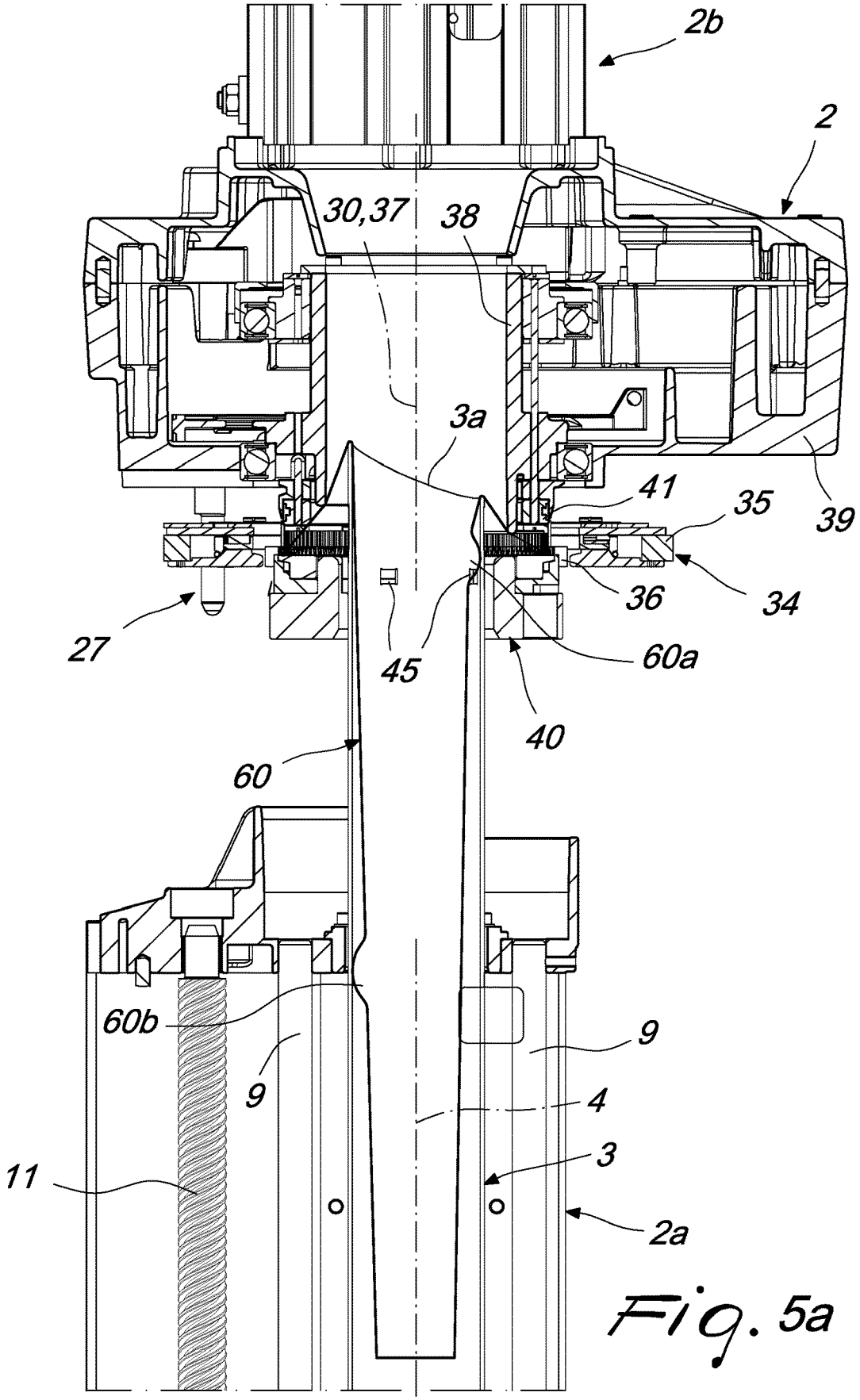
Figure 5B:
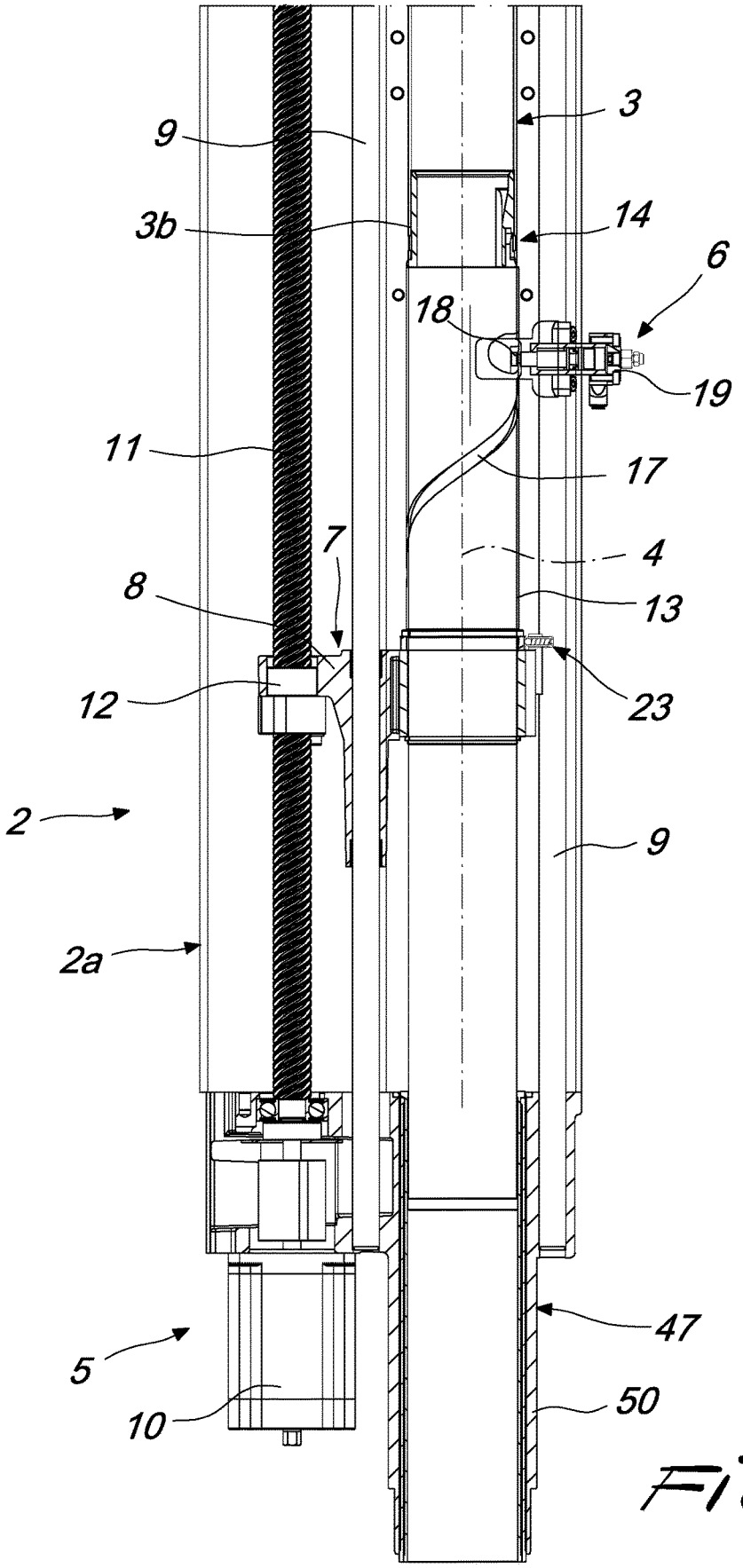
Figure 5C:
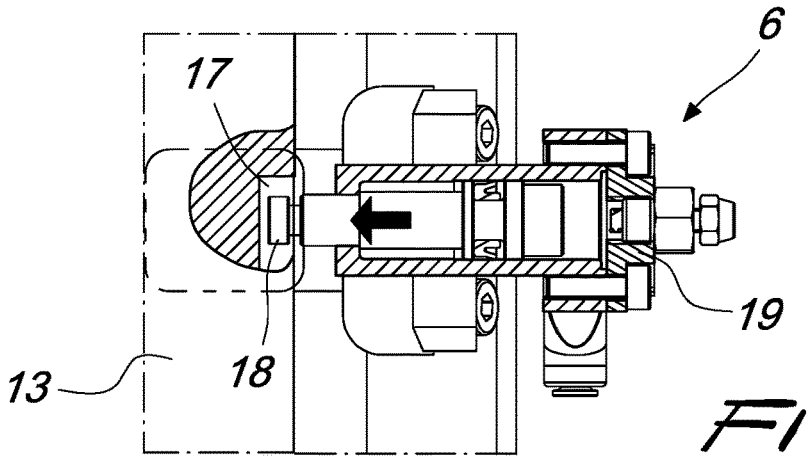
Figure 6:
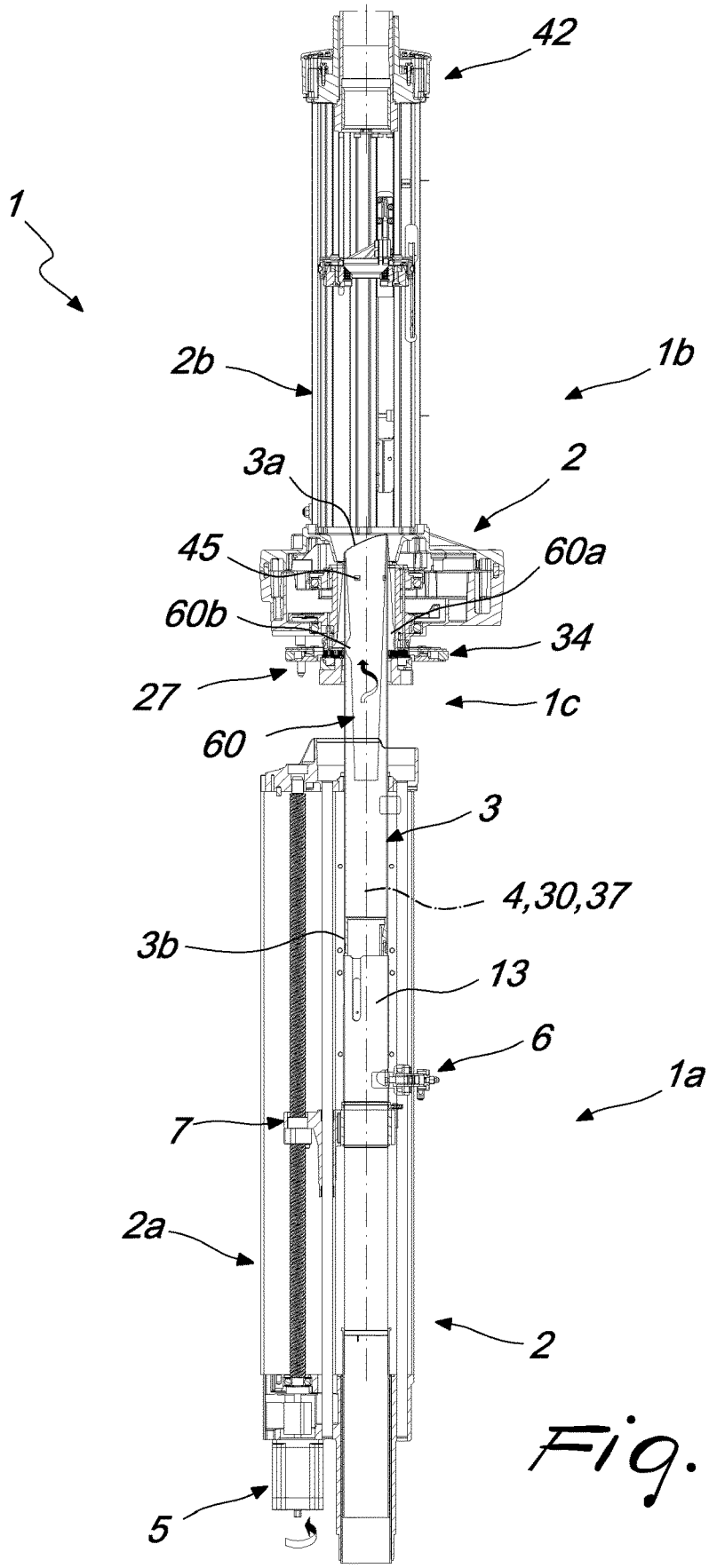

FIG. 1*d* is another enlarged portion of FIG. 1;

FIG. 2 shows a step of the transition of the article from a pickup device, used to pick it up from the machine that produced it, to a handling device arranged at the linking or sewing station;

FIG. 2*a* is an enlarged portion of FIG. 2;

FIG. 3 shows another step of the transition of the article from the pickup device to the handling device, with a portion of the turning device shown exposed;

FIG. 3*a* is an enlarged portion of FIG. 3;

FIG. 4 shows the start of the inversion of the article;

FIG. 4*a* is an enlarged portion of FIG. 4;

FIG. 4*b* is another enlarged portion of FIG. 4;

FIGS. 5 and 6 show the execution of the rotation of the tubular body about its own axis;

FIG. 5*a* is an enlarged portion of FIG. 5;

FIG. 5*b* is another enlarged portion of FIG. 5;

FIG. 5*c* is a further enlarged detail of FIG. 5*b;*

Figure 5D:
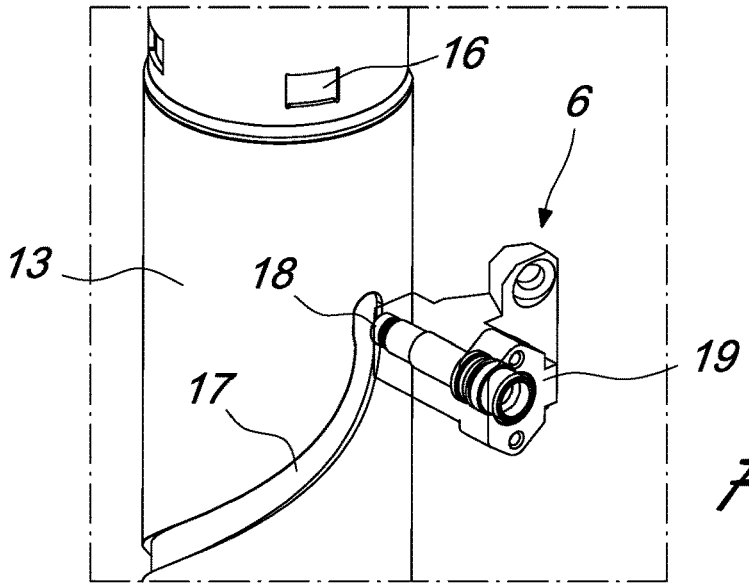
Figure 5E:
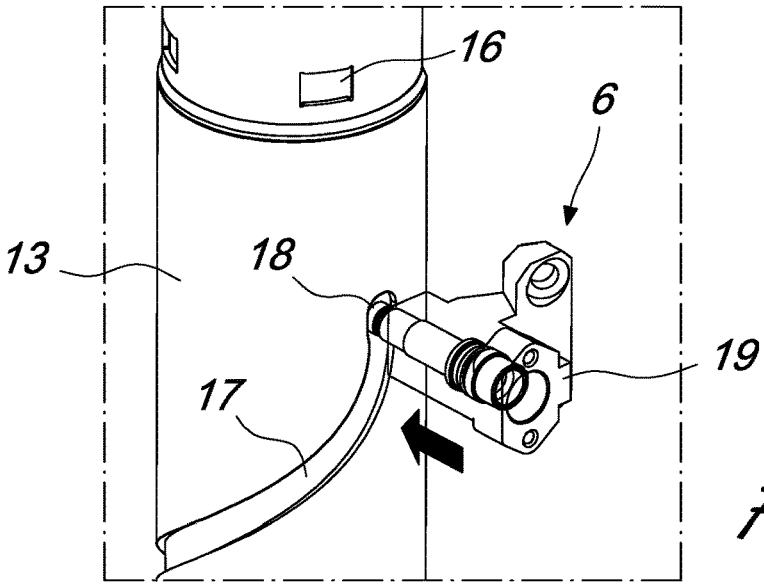
Figure 6A:
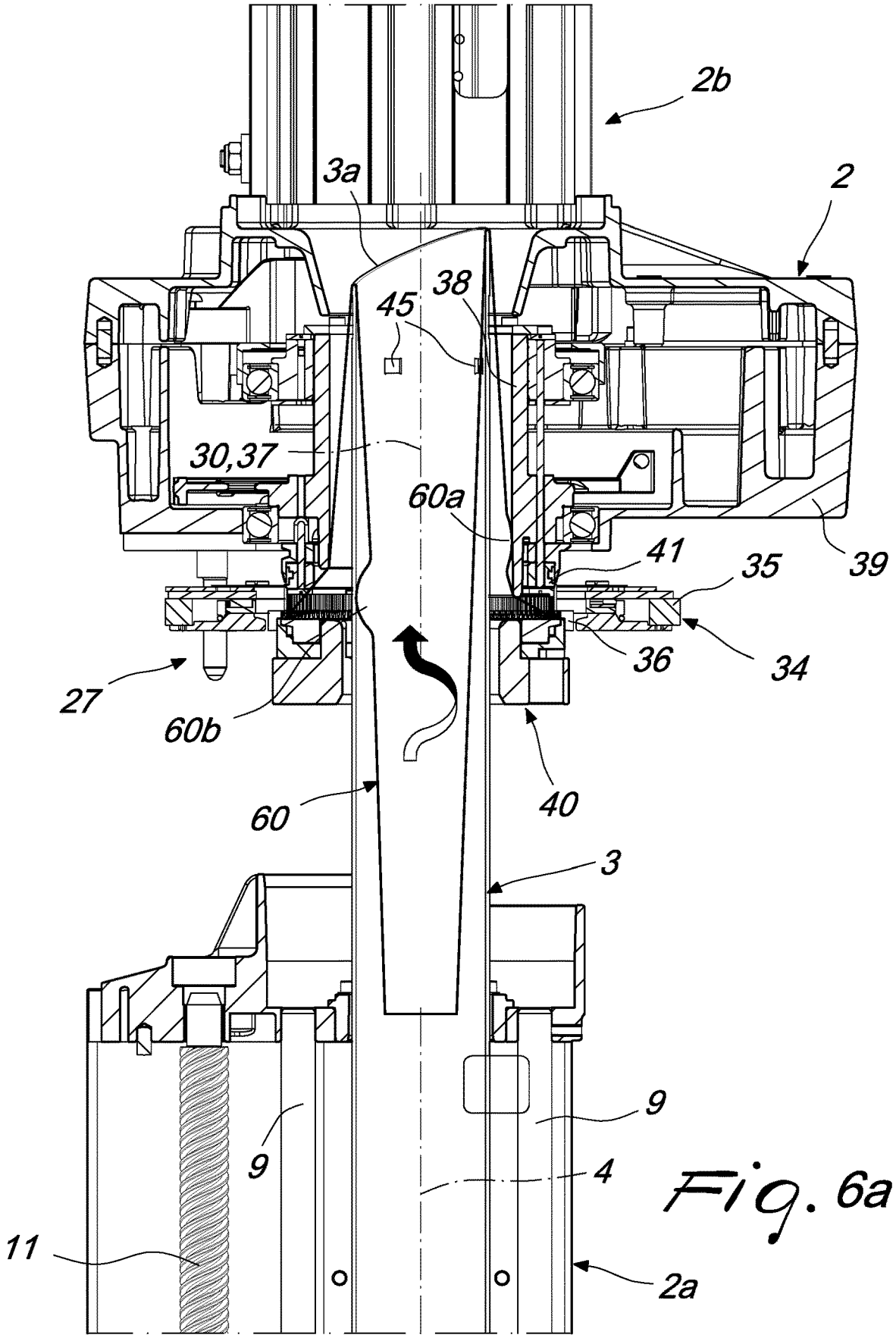
Figure 6B:
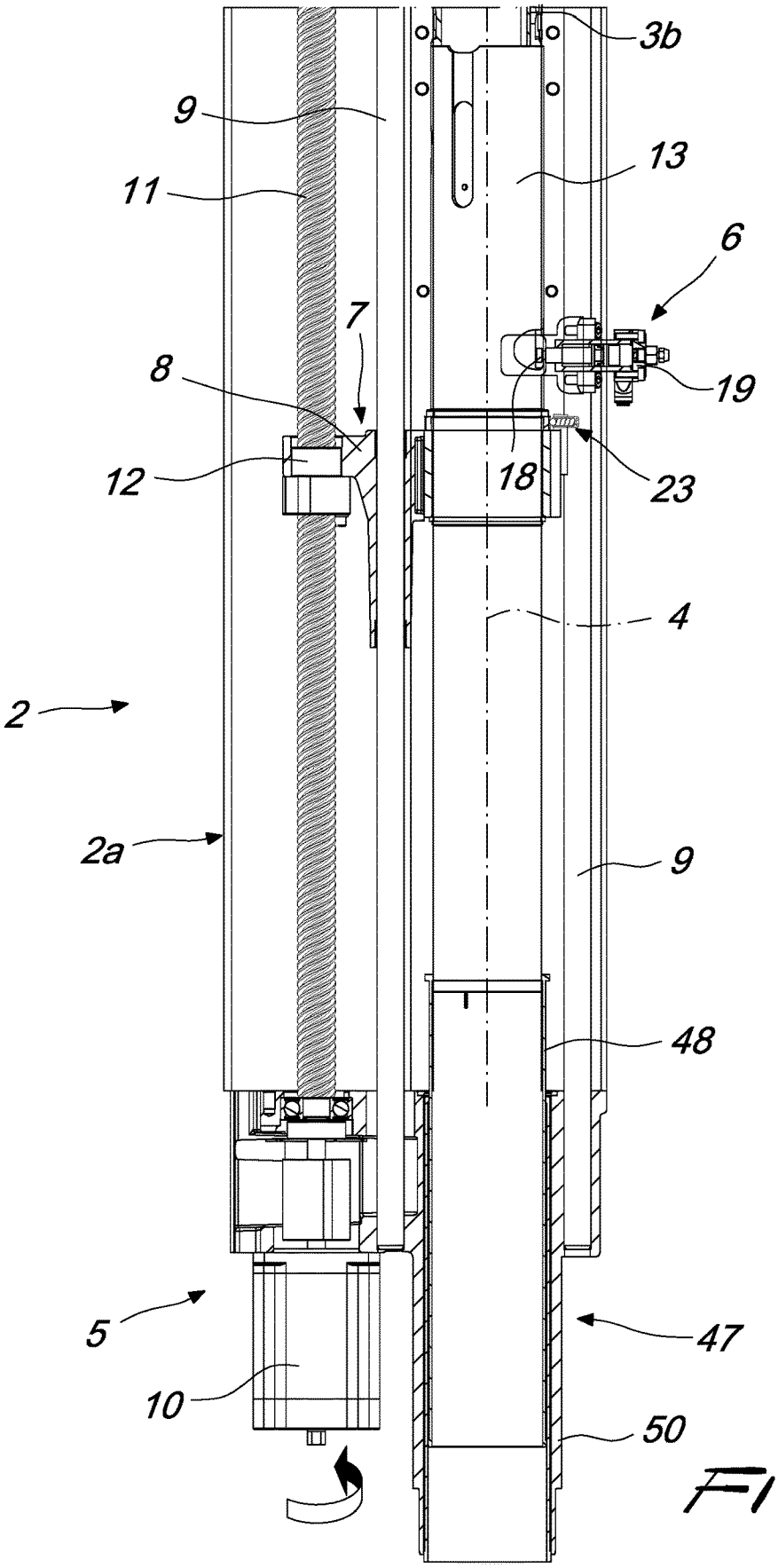
Figure 7:
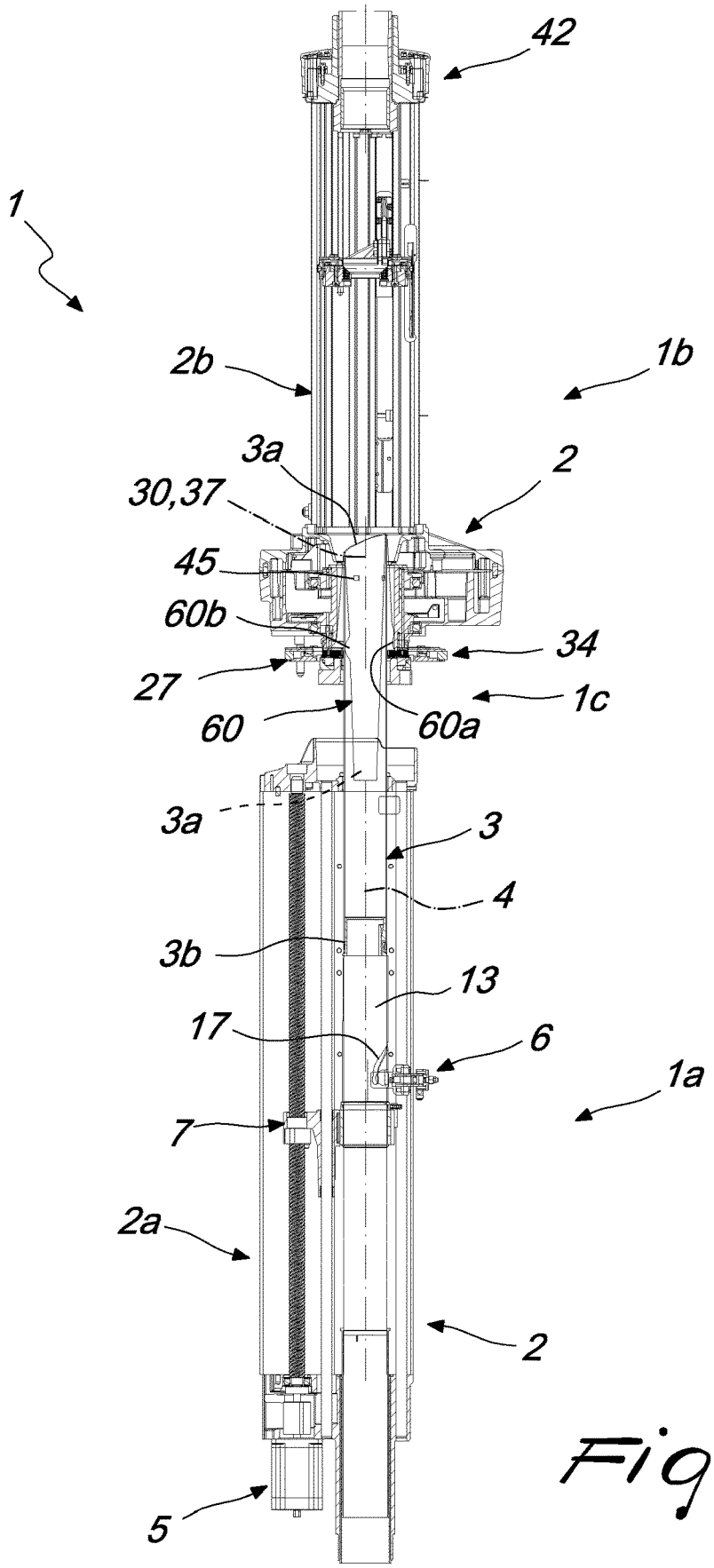
Figure 7A:
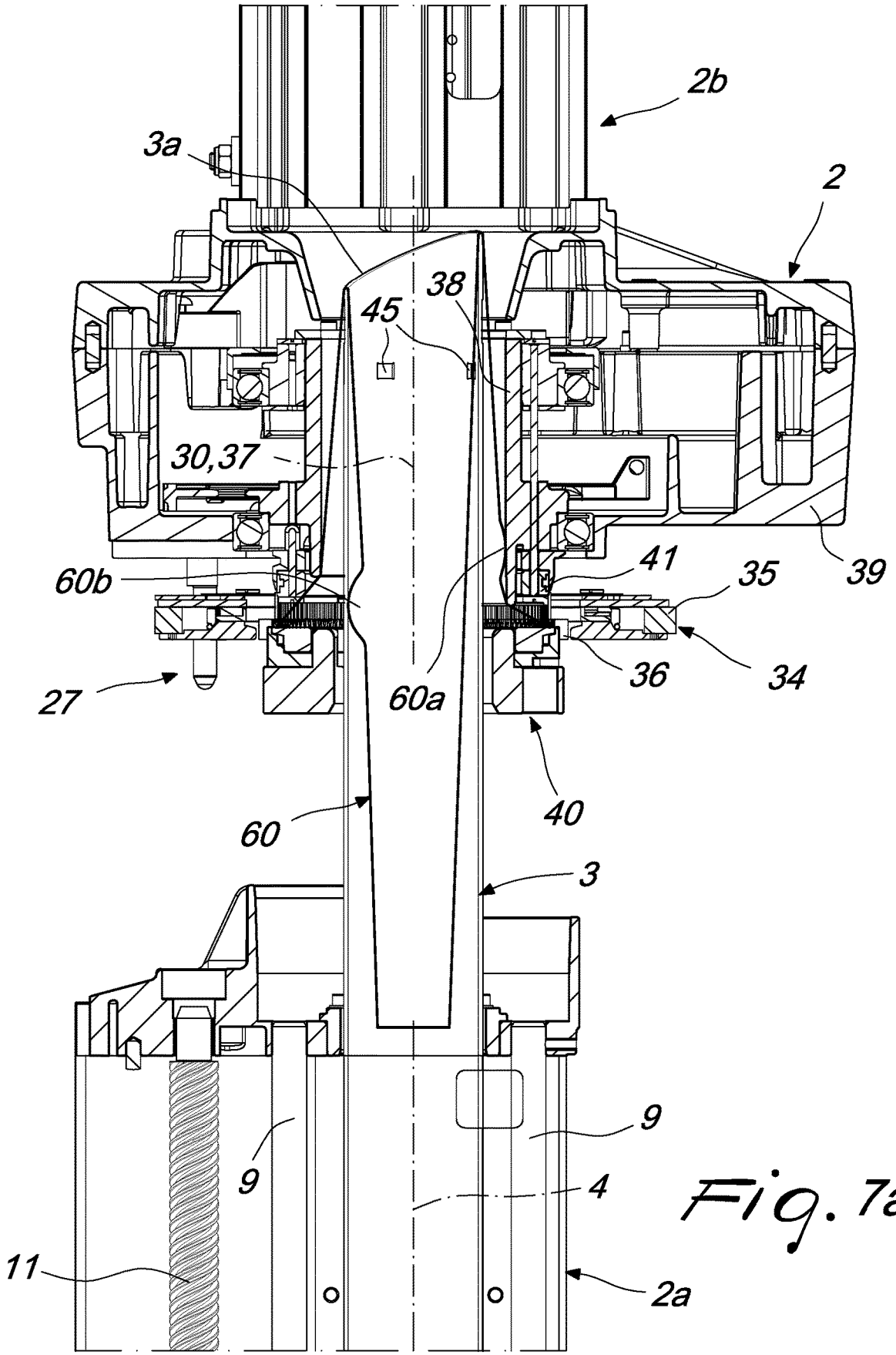
Figure 7B:
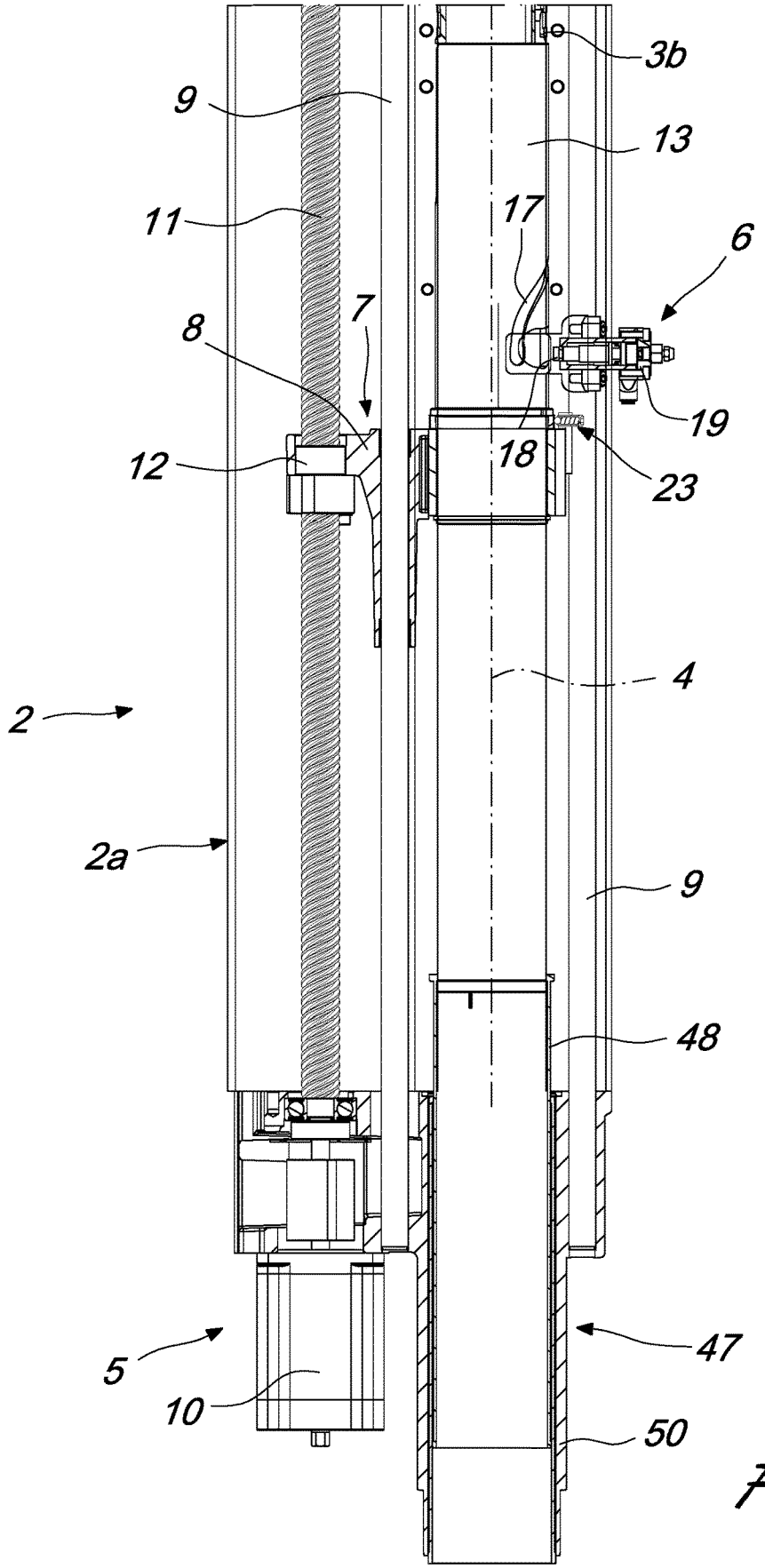
Figure 7C:
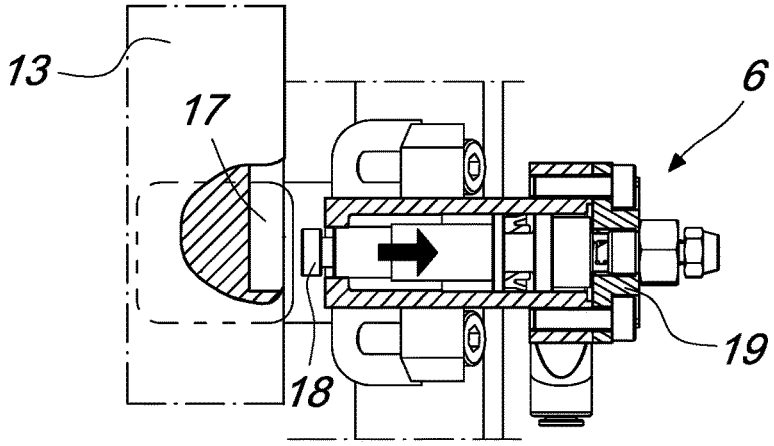

FIGS. 5*d* and 5*e* schematically illustrate, in a perspective view, the operation of the second actuation means in relation to the step of inversion shown in FIG. 5;

FIG. 6*a* is an enlarged portion of FIG. 6;

FIG. 6*b* is another enlarged portion of FIG. 6;

FIG. 7 shows an intermediate step of the inversion of the article;

FIG. 7*a* is an enlarged portion of FIG. 7;

FIG. 7*b* is another enlarged portion of FIG. 7;

FIG. 7*c* is a further enlarged detail of FIG. 7*b;*

Figure 7D:
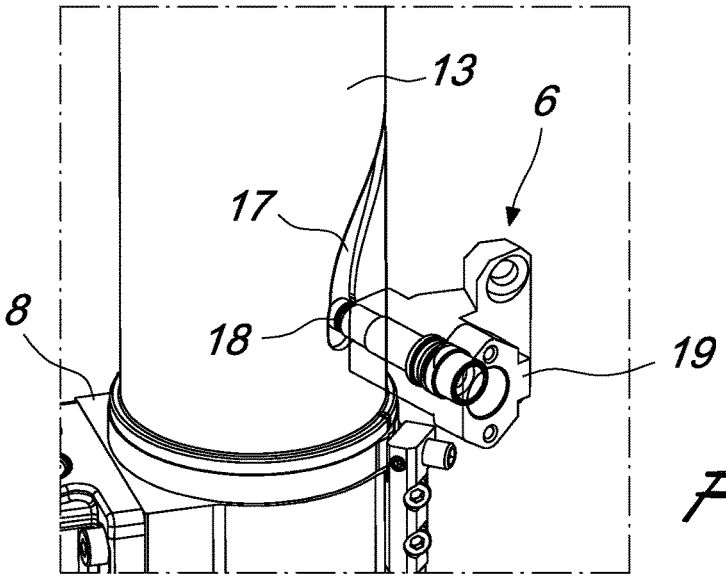
Figure 7E:
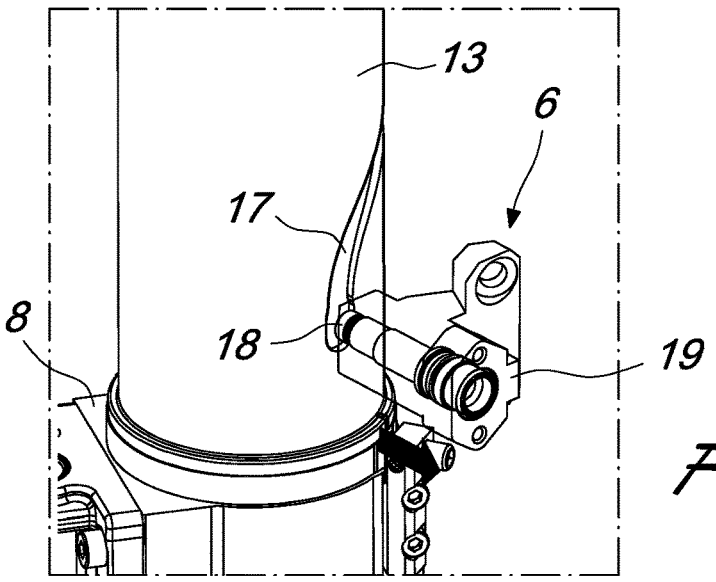
Figure 8:
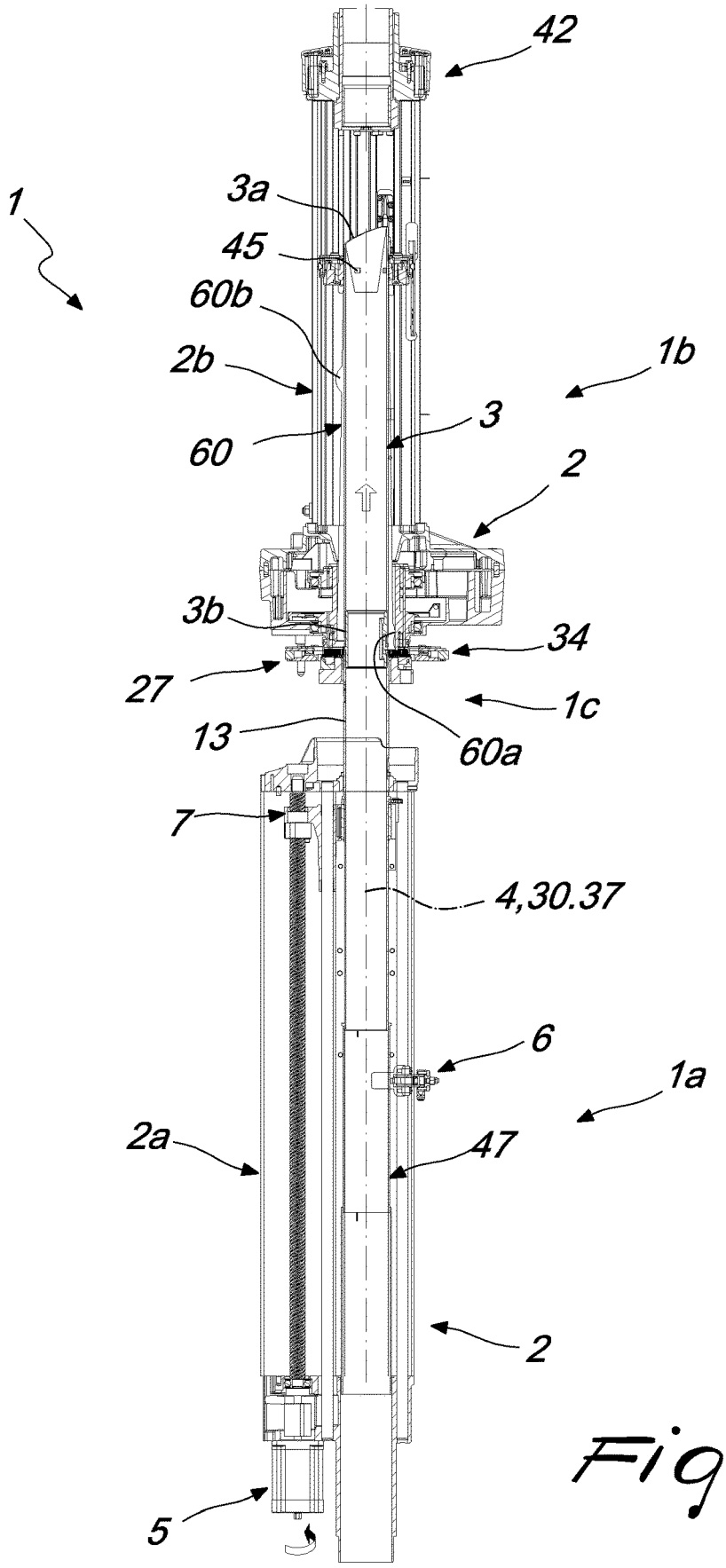
Figure 8A:
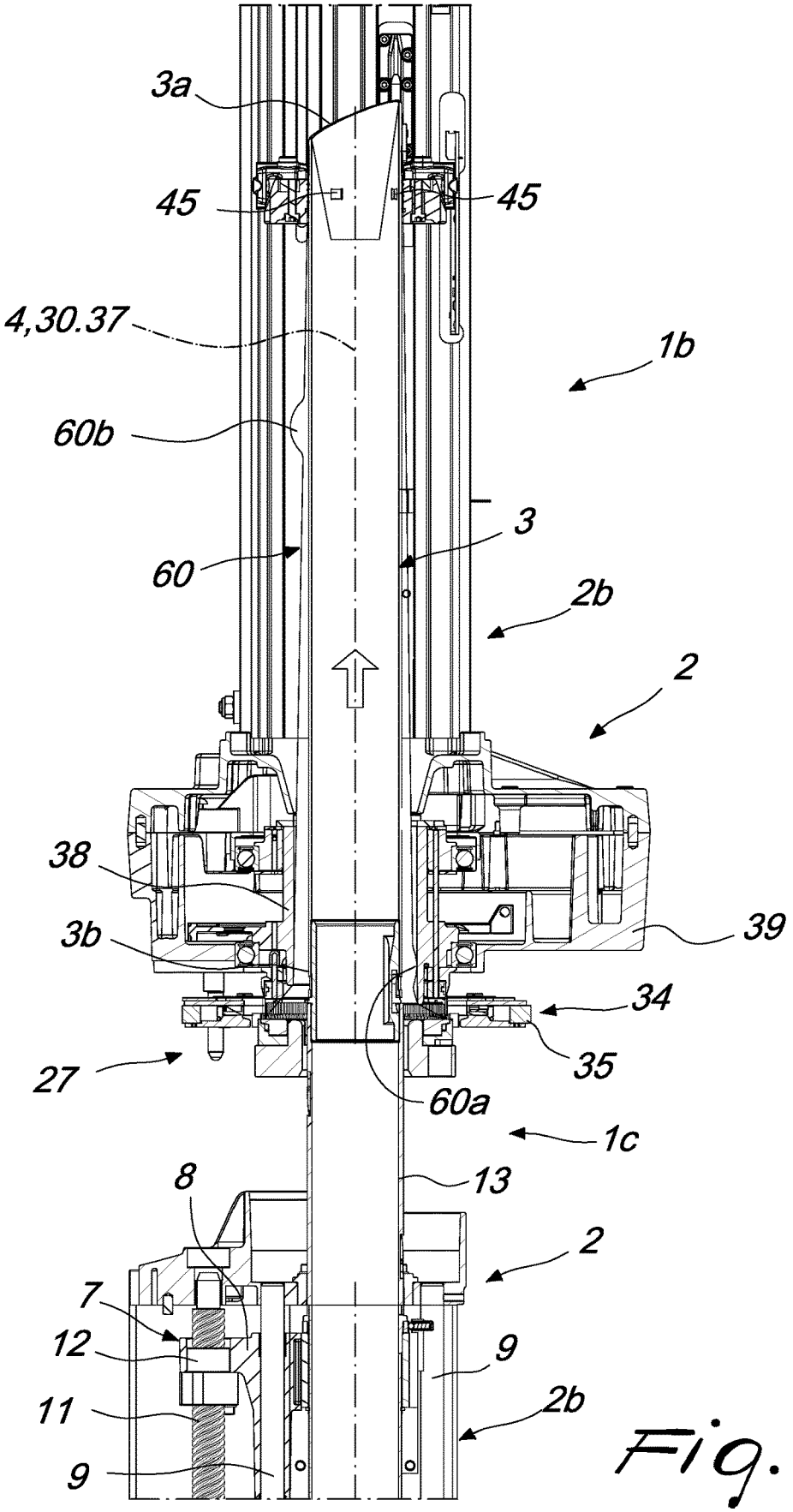
Figure 8B:
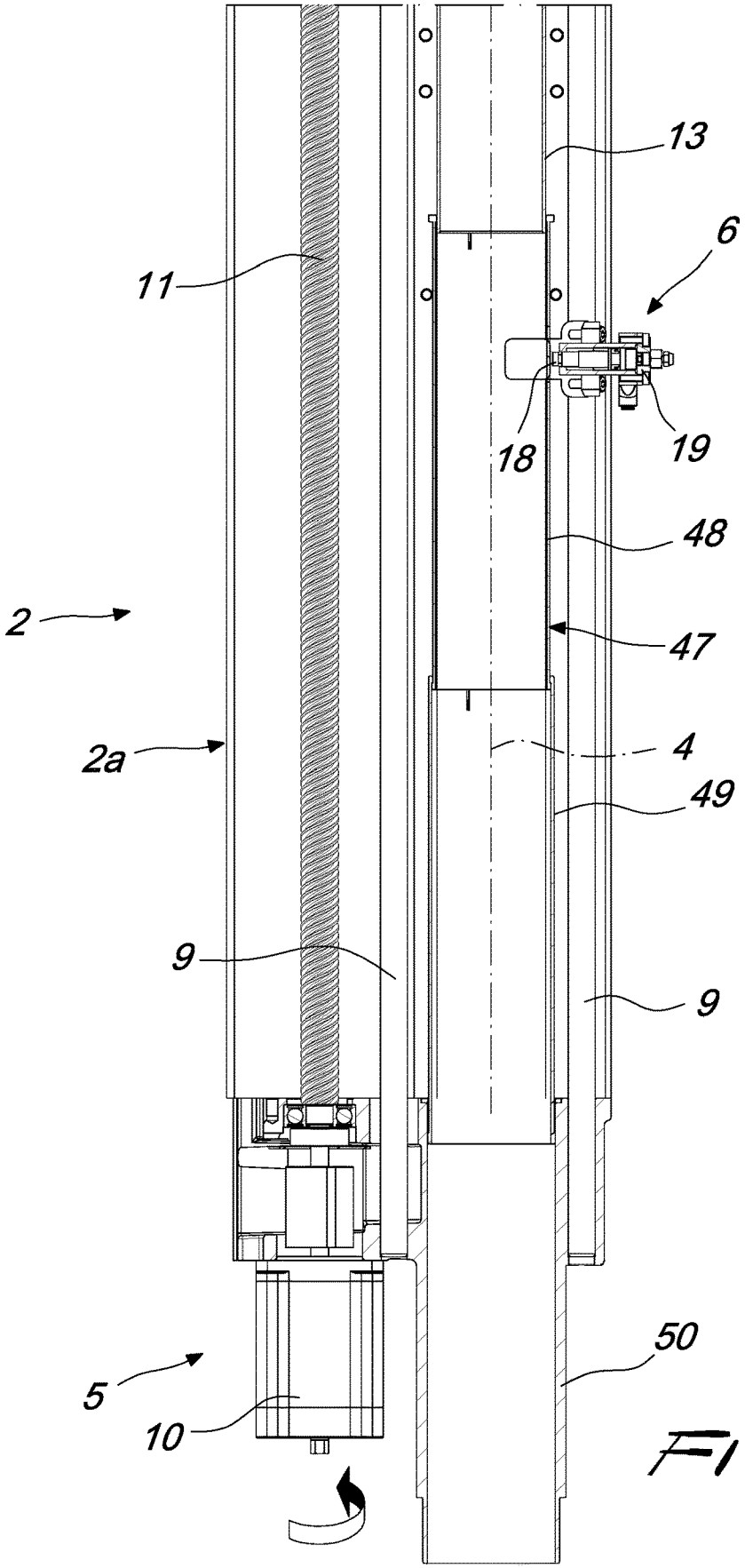
Figure 9:
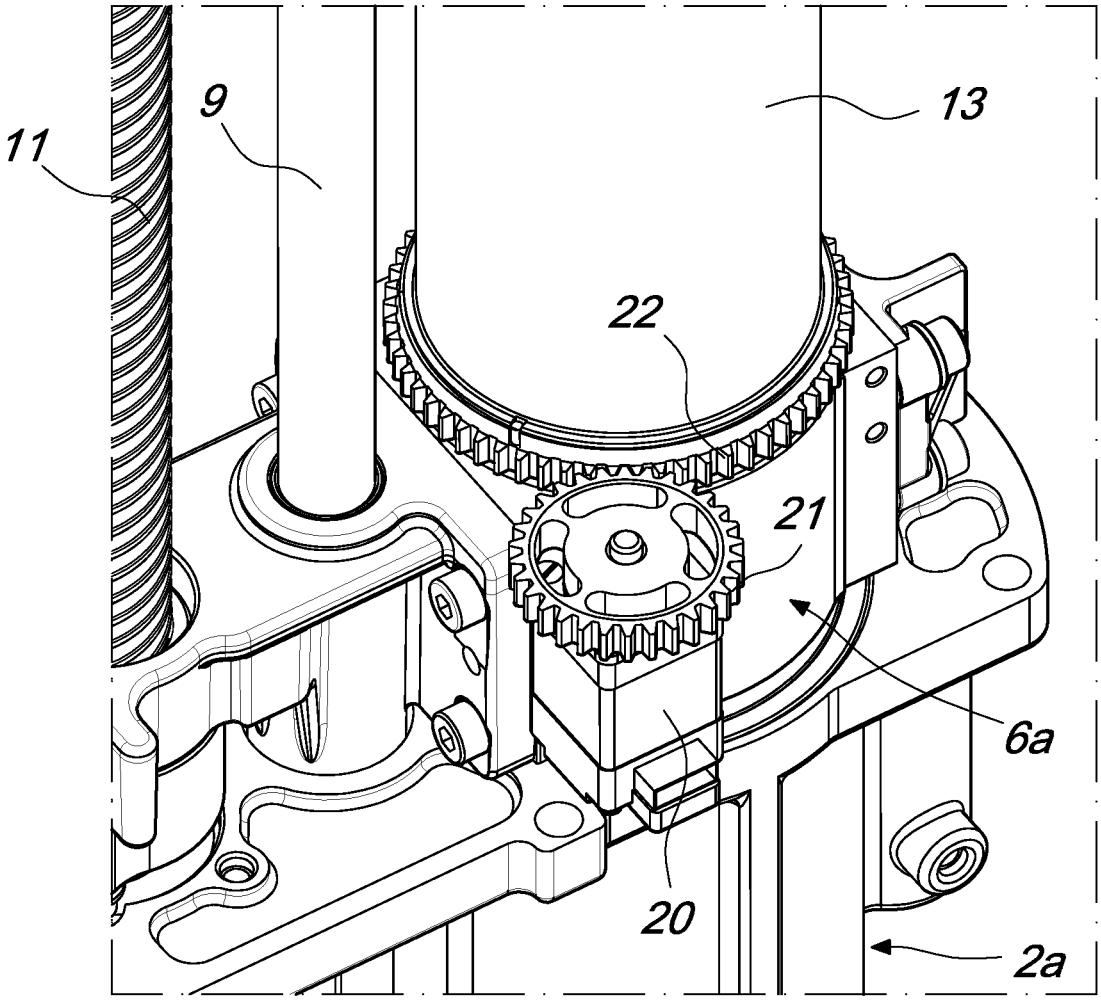

FIGS. 7*d* and 7*e* schematically illustrate, in a perspective view, the operation of the second actuation means in relation to the step of inversion shown in FIG. 7;

FIG. 8 shows the inversion of the article almost completed;

FIG. 8*a* is an enlarged portion of FIG. 8;

FIG. 8*b* is another enlarged portion of FIG. 8;

FIG. 9 schematically illustrates, in a perspective view, a variation of execution of the second actuation means.

The turning device according to the invention will be described with reference to its preferred use in a linking or sewing station for executing the closure of one axial end of a knitted tubular article, such as for example a sock, produced on a circular machine for knitting or hosiery, without affecting the fact that the turning device according to the invention can be used, more generally, simply to carry out the inversion of a tubular article independently of whether or not it is then closed by way of sewing or linking one of its axial ends.

With reference to the figures, the turning device according to the invention, generally designated by the reference numeral 1, comprises a main supporting structure 2 which supports a tubular body 3 arranged with its axis 4 substantially vertical.

The tubular body 3 has its upper axial end 3*a* beveled along a plane that is inclined with respect to its axis 4.

The turning device comprises first actuation means 5 which can be activated to perform a translation of the tubular body 3 along its axis 4 with respect to the main supporting structure 2. By way of this translation, the tubular body 3 is insertable, with its upper axial end 3*a*, through an axial end of a tubular article 60 in order to turn it inside out.

According to the invention, the turning device in question comprises second actuation means 6 which can be activated to rotate the tubular body 3 about its own axis 4, through an angle of preset breadth, with respect to the main supporting structure 2.

The tubular body 3 is supported, so that it can rotate about its own axis 4, by a corresponding supporting element 7 which is supported, so that it can slide along a direction that is substantially parallel to the axis 4 of the tubular body 3, by the main supporting structure 2.

More specifically, the supporting element 7 of the tubular body 3 comprises a slider 8 which can slide along a pair of vertical guides 9 which are fixed to the main supporting structure 2.

The first actuation means 5 comprise an electric motor 10 which is fixed with its body to the main supporting structure 2 and is connected, with its output shaft, to a threaded shaft 11 with a vertical axis which is supported, so that it can rotate about its own axis, by the main supporting structure 2.

The threaded shaft 11 mates with a female thread 12 associated with the slider 8 so that the actuation with a rotary motion about its own axis of the threaded shaft 11, done by the electric motor 10, causes the translation of the slider 8 along the guides 9 and therefore the translation of the tubular body 3 parallel to its axis 4 with respect to the main supporting structure 2.

The tubular body 3 is connected, by way of its lower axial end 3*b*, to a lower sleeve 13, coaxial thereto, which is supported, so that it can rotate about its own axis, by the supporting element 7 of the tubular body 3 i.e. by the slider 8.

The tubular body 3 is connected to the lower sleeve 13, by way of its lower axial end 3*b*, detachably and integral in rotation about its own axis 4, which coincides with the axis of the lower sleeve 13, so that the rotation of the lower sleeve 13 about its own axis causes the rotation of the tubular body 3 around the same axis when the lower sleeve 13 and the tubular body 3 are connected to each other and so that the tubular body 3 can be engaged with or disengaged from the lower sleeve 13, preferably by way of an axial sliding of the lower sleeve 13 with respect to the tubular body 3 or vice versa.

Conveniently, the lower sleeve 13 is provided with elastic means 14 which are engageable with the tubular body 3 or disengageable from the tubular body 3 proximate to the lower axial end 3*b* thereof.

More specifically, these elastic means 14 comprise at least one elastic lamina 15 which is arranged on the portion of the lower sleeve 13 which is insertable in the lower axial end 3*b* of the tubular body 3 and protrudes from the lateral surface of the lower sleeve 13. Such elastic lamina 15 is engageable in a corresponding hole 16 which passes through the portion of the lower axial end 3*b* of the tubular body 3 in which the lower sleeve 13 is insertable. In substance, the elastic lamina 15, in the absence of forces acting on it, protrudes from the lateral surface of the lower sleeve 13 and is elastically bent toward the axis of the lower sleeve 13 when this is inserted in the lower axial end 3*b* of the tubular body 3 in order to then engage, by elastic reaction, with the hole 16 that radially passes through the tubular body 3 when such hole 16 is positioned at the elastic lamina 15. Following the engagement of the elastic lamina 15 with the hole 16, the tubular body 3 is connected, integrally, in rotation about the common axis 4, to the lower sleeve 13. It should be noted that the lower sleeve 13 can be disengaged from the tubular body 3 by extracting it from its lower axial end 3*b*. By acting in this manner, the elastic lamina 15 is in fact bent once again in the direction of the axis 4 of the lower sleeve 13, thus disengaging it from the hole 16.

The elastic lamina 15 is contoured so as to facilitate the insertion in the tubular body 3, and the extraction from the tubular body 3, of the lower sleeve 13.

The second actuation means 6 comprise a cylindrical helical slot 17 which extends on the lateral surface of the lower sleeve 13 and a pin 18 which is supported by the main supporting structure 2 and which is engageable on command with such cylindrical helical slot 17 upon the translation of the lower sleeve 13, together with the tubular body 3, along its axis 4 with respect to the main supporting structure 2 by the action of the first actuation means 5.

More specifically, the pin 18 is supported by the main supporting structure 2 so as to laterally face the lower sleeve 13 when the tubular body 3 is translated along its axis 4 with respect to the main supporting structure 2.

The pin 18 is constituted by a bearing which is fixed to the stem of the piston of a pneumatic actuator 19 which can be actuated to cause the movement of the bearing 18 along a direction perpendicular to the axis 4 of the tubular body 3, from a rest position, in which it is spaced apart from the lateral surface of the lower sleeve 13, to an activation position, in which it engages with the cylindrical helical slot 17 defined on the lateral surface of the lower sleeve 13, or vice versa.

Obviously, the movement of the bearing or pin 18 from the rest position to the activation position or vice versa can be caused by other conventional actuators, for example mechanical or electromechanical actuators.

The pin 18 is supported by the main supporting structure 2 so as to be facing toward the lateral surface of the lower sleeve 13 when the tubular body 3 is in an intermediate lifted position as a consequence of the activation of the first actuation means 5.

Preferably, the cylindrical helical slot 17 extends on the lateral surface of the lower sleeve 13 about the axis 4 of the tubular body 3 through an angle of substantially 180° so that the translation of the tubular body 3 along its axis 4 in combination with the engagement of the pin 18 inside the cylindrical helical slot 17 causes a rotation of the tubular body 3 about its own axis 4 of substantially 180°.

In the embodiment of the second actuation means 6 which is described above, the rotation of the tubular body 3 about its own axis 4 together with the lower sleeve 13 with respect to the main supporting structure 2 is subject to the translation of the tubular body 3 along its axis 4 together with the lower sleeve 13 with respect to the main supporting structure 2.

In the variation of execution shown in FIG. 9, the second actuation means, designated in this case with the reference numeral 6*a*, are made so as to actuate the rotation of the lower sleeve 13 together with the tubular body 3 about its own axis 4 with respect to the main supporting structure 2 without necessarily requiring a translation of the tubular body 3 together with the lower sleeve 13 along its axis 4 with respect to the main supporting structure 2. In such variation of execution, in fact, the second actuation means 6*a* comprise an electric motor 20 which is mounted on the slider 8 and is connected with its output shaft to a pinion 21 which meshes with a ring gear 22 which is fixed coaxially about the lower sleeve 13.

In FIG. 9, the elements of the turning device that correspond to the elements already described in the previous figures have been marked with the same reference numerals.

Conveniently, the inverting device according to the invention comprises means 23 of retention of the tubular body 3 in preset rotational positions that are angularly mutually spaced apart about the axis 4 of the tubular body 3.

More specifically, such retention means 23 comprise a snap pin 24 which is supported by the slider 8 and which faces a region of the lateral surface of the lower sleeve 13 in which seats 25 which are engageable by such snap pin 24 are defined, in positions that are angularly mutually spaced apart around the axis 4 of the tubular body 3, according to angles of preset breadth. In the embodiment shown, which entails a rotation of the tubular body 3 about its own axis 4 through an angle of 180°, there are two seats 25 arranged in two diametrically opposite regions on the lateral surface of the lower sleeve 13.

The turning device according to the invention can be provided with a lower part 1*a*, which comprises a lower portion 2*a* of the main supporting structure 2 which supports the tubular body 3 so that it can slide along its own axis 4 and the first actuation means 5, and with an upper part 1*b*, which comprises an upper portion 2*b* of the main supporting structure 2 which supports means 26 for gripping the upper axial end 3*a* of the tubular body 3.

Between the upper part 1*b* and the lower part 1*a* of the inverting device, there is an intermediate region 1*c* at which means 27 can be arranged, or are arranged, for supporting the tubular article 60 to be turned inside out, which is hung at an axial end thereof and is arranged substantially vertically. The tubular body 3, as will be better described later, is insertable, upward from below, with its upper axial end 3*a*, through the axial end of the article 60 which is hung from the supporting means 27 after aspirating the article 60 through the upper axial end 3*a* of the tubular body 3 so as to cause the eversion of the article 60, retained by the supporting means 27, on the outer lateral surface of the tubular body 3 with progressive extraction of the article 60 from the upper axial end 3*a* of the tubular body 3.

More specifically, the supporting means 27 of the article 60, arranged at the intermediate region 1*c* between the lower part 1*a* and the upper part 1*b* of the turning device, comprise a handling device 28 which is provided with an annular body 29 which is arranged with its axis at a vertical main axis 30. On its lower face, the body 29 is provided with a plurality of spikes 31 which are arranged along an ideal cylindrical surface, the axis of which coincides with the main axis 30, and which extend parallel to such main axis 30. Such spikes 31 are adapted to support the article 60 to be turned inside out hung on the spikes 31 with its upper end, and the tubular body 3 is arrangeable with its axis 4 at the main axis 30 and can move on command along such axis 30 at least partly by the action of the first actuation means 5. In the accompanying figures, the tubular body 3 is shown in this position.

If the turning device, as in the embodiment shown, is intended to be positioned in a linking or sewing station for the closure of one axial end of the article 60, the body 29 of the handling device 28 is preferably composed of two half-rings 32*a*, 32*b* which are mutually pivoted about a diametrical axis 33. One of the two half-rings 32*a*, 32*b*, constituted by the half-ring 32*a*, can be overturned on command with respect to the other half-ring 32*b* about the diametrical axis 33 so as to bring each spike 31 of the half-ring 32*a* to face and align with a corresponding spike 31 of the half-ring 32*b*. Preferably, when the two half-rings 32*a*, 32*b* are in a co-planar position, the spikes 31 are directed with their points downward and the half-ring 32*a* can be overturned about a diametrical axis 33 so as to face the half-ring 32*b* from below. The handling device 28 can be moved from the linking or sewing station to the machine used for producing the article 60 to be turned inside out, and vice versa, so that it can carry out the pickup of the article 60 from the machine and bring it to the linking or sewing station.

Alternatively, as in the embodiment shown, the handling device 28 is arranged permanently in the linking or sewing station and the article 60 to be turned inside out is taken from the machine that produced it and transferred to the handling device 28 by way of a pickup device, generally designated by the reference numeral 34. The pickup device 34 comprises an annular pickup body 35, which supports a plurality of pickup elements 36 and is arranged with its axis 37 vertical. Each pickup element 36 has a lamina body which is arranged in a radial plane with respect to the axis 37 of the pickup body 35 and which can move on command toward or away with respect to the axis 37 of the pickup body 35. The pickup elements 36 are angularly mutually spaced apart regularly about the axis 37 and corresponding to the angular spacing between the needles of the circular machine for knitting or for hosiery used for the production of the article 60 so that, by positioning the pickup body 35 coaxially about the needle cylinder of the machine and moving it conveniently along its axis 37, each pickup element 36 is radially facing a needle of the machine. The pickup elements 36, in the example shown, have their end which is directed toward the axis 37 of the pickup body 35 shaped like a hook open upward. Such end is engageable with the corresponding needle of the machine, toward which each pickup element 36 faces, so as to pick up the loop of knitting from such needle and thus removing the article 60 from the machine that produced it. The same end of each pickup element 36 can be coupled with a spike 31 so as to execute the transfer of the article 60 from the pickup device 34 to the handling device 28. The spikes 31 are in fact angularly mutually spaced apart about the axis of the body 29 of the handling device 28, regularly according to an angular spacing corresponding to the spacing that exists between the pickup elements 36 of the pickup device 34. In essence, each pickup element 36 corresponds to a spike 31 of the handling device 28 and, when the pickup device 34 is arranged in the linking or sewing station, the pickup body 35 is arranged in position coaxial to the body 29 of the handling device 28 with the pickup elements 36 arranged around the annulus of spikes 31 and with each pickup element 36 in radial alignment with a spike 31.

The transfer of the loops of knitting of the article 60 from the pickup elements 36 to the spikes 31 of the handling device 28 is carried out by positioning the pickup body 35 coaxially below the body 29 of the handling device 28 and engaging the end of each pickup element 36 with one of the spikes 31 while the half-ring 32*a* is in the co-planar position with respect to the half-ring 32*b* and that is to say before executing the overturning thereof below the half-ring 32*b*, as will be better described below.

In the embodiment shown, the body 29 of the handling device 28 is connected coaxially around a vertical-axis hollow cylinder 38 which is supported so that it can rotate about its own axis, which coincides with the main axis 30, by a corresponding supporting structure 39. The half-ring 32*b* is fixed to the outer lateral surface of the hollow cylinder 38 while the half-ring 32*a* is pivoted to the hollow cylinder 38 about the diametrical axis 33.

The half-ring 32*a* can be overturned about the diametrical axis 33 and the hollow cylinder 38 can be actuated with a rotary motion about its own axis with respect to the supporting structure 39 in a way that is known per se, for example as described in the EP 2,250,307 B1 patent.

Conveniently, there are first axial pusher means 40 which interact with the pickup elements 36 of the pickup device 34, when these are coupled with the spikes 31, and with the same spikes 31 of the handling device 28 so as to actuate the individual transition of the loops of knitting from the pickup elements 36 to the spikes 31, obviously if the pickup element 36 is provided.

Furthermore, there are second axial pusher means 41 which interact with the spikes 31 of the handling device 28 in order to actuate the transition of the loops of knitting from the spikes 31 of the half-ring 32*b* to the spikes 31 of the half-ring 32*a* when this is overturned below the half-ring 32*b* or in order to disengage the article 60 from the spikes 31 of the half-ring 32*a* after the sewing or linking operation.

The first axial pusher means 40 and the second axial pusher means 41 can be provided in a way that is known per se, for example as described in the EP 2,250,307 B1 patent.

The upper part 1*b* of the turning device according to the invention comprises the grip means 26 which are engageable with the upper axial end 3*a* of the tubular body 3 and there are third actuation means 42 which are activatable in order to execute a further lifting of the tubular body 3 in addition to the lifting that is obtainable by way of the first actuation means 5.

The grip means 26 and the third actuation means 42 comprise an upper sleeve 43 which is arranged with its axis at the main axis 30. Such upper sleeve 43 can move, by the action of the third actuation means 42, along the main axis 30 with respect to the main supporting structure 2. Such upper sleeve 43 can be fitted over the upper axial end 3*a* of the tubular body 3 and is provided with at least one peg, non visible in the figures, which is engageable with a hole 45 which radially passes through the tubular body 3 proximate to its upper axial end 3*a* in the region that is intended to be inserted inside the upper sleeve 43.

The actuation of the upper sleeve 43 along the main axis 30, and also the actuation of the peg in order to perform the hooking or the unhooking of the upper axial end 3*a* of the tubular body 3, can be executed in a way that is known per se, for example as described in the EP 2,250,307 B1 patent.

The turning device according to the invention can also be provided with auxiliary sliding means 46 which are arranged above the body 29 of the handling device 28 so as to be facing the outer lateral surface of the tubular body 3, when this protrudes above the hollow cylinder 38. The auxiliary sliding means 46 are cyclically engageable with and disengageable from the part of the article 60 that is already extroverted on the outer surface of the tubular body 3 and are axially moveable with respect to the tubular body 3 so as to assist and complete the eversion of the article 60 on the outer surface of the tubular body 3. Such auxiliary sliding means 46 can be provided and actuated in a manner similar to that described in the EP 2,250,307 B1 patent.

The upper sleeve 43 can be connected, in a way that is known per se, to suction means.

The lower sleeve 13 can also be connected to conventional suction means. More specifically, the lower sleeve 13 passes through the slider 8 and is connected, below the slider 8, to a telescopic tube 47 which is composed of multiple tubular portions 48-50 which are inserted coaxially, so that they can slide, one inside the other. The lower end of the telescopic tube 47 can be connected, in a way that is known per se, to the aspiration intake of an aspiration device or to an air suction line.

The lower portion 2*a* of the main supporting structure 2 can be provided fixed or able to rotate about a horizontal axis, as illustrated in the EP 2,250,307 B1 patent, so that it can be inclined laterally with the its upper end toward the machine for producing the article 60 in order to facilitate the sucking of the article 60 through the upper axial end 3*a* of the tubular body 3 during its transfer from the production machine to the handling device 28 performed by way of the pickup device 34.

Operation of the turning device according to the invention, in the preferred hypothesis that it be used in a linking or sewing station for the closure of one axial end of knitted tubular articles, is the following.

In conditions of rest, the turning device is with the tubular body 3 supported by the lower portion 2*a* of the main supporting structure 2, completely lowered and with its axis coinciding with the main axis 30.

Once the article 60 to be turned inside out has been picked up from the machine used for its production, assuming a pickup device 34 is used which is intended to deliver the article 60 to the handling device 28 which will support it during the inversion, the pickup body 35, which retains the loops of knitting of the last row of knitting formed of the article 60 with its pickup elements 36, is positioned with its axis 37 at the main axis 30 below the body 29 of the handling device 28, as illustrated in FIG. 1.

The upper axial end 3*a* of the tubular body 3 faces from below the article 60 carried by the pickup device 34 and the inside of the tubular body 3 is connected to suction means so that the article 60 is sucked through the upper axial end 3*a* of the tubular body 3 inside the tubular body 3 itself.

The pickup body 35, which is between the upper axial end 3*a* of the tubular body 3 and the two half-ring gears 32*a*, 32*b*, which are in the co-planar position, is then lifted, in a way that is known per se, so that each one of the pickup elements 36 couples with a spike 31, as illustrated in FIG. 2.

Then the first axial pusher means 40 are actuated, and these cause the transfer of the loops of the article 60, which are hooked on the pickup elements 36, from each pickup element 36 to a corresponding spike 31, thus achieving the transfer of the article 60 from the pickup device 34 to the handling device 28, as illustrated in FIG. 3.

At this point, the electric motor 10 is actuated and lifts, along its axis 4 which coincides with the main axis 30, the tubular body 3 which begins to pass through, by way of its upper axial end 3*a*, the pickup body 35 and the body 29 of the handling device 28 and therefore the axial end of the article 60 engaged with the spikes 31, as illustrated in FIG. 4.

It should be noted that, until this step, the tubular body 3 was arranged with the tip of its beveled end arranged on the side with the article 60 on which the pocket 60*b* of the heel is present and that is to say the pocket that is spaced furthest apart from the end of the article 60 that was hooked first to the pickup device 34 and then to the handling device 28.

When the lifting of the tubular body 3 is such that this pocket 60*a*, which constitutes the toe cap of the article 60, is passed onto the outer lateral surface of the tubular body 3 or is still inside the tubular body but very near the upper axial end 3*a* of the tubular body 3, the lower sleeve 13 is with its cylindrical helical slot 17 facing the bearing or pin 18, as illustrated in FIG. 5.

At this point, the bearing or pin 18, by way of the actuation of the pneumatic actuator 19, is brought from the rest position, in which it was previously, to the activation position thus engaging with such cylindrical helical slot 17, as shown in FIGS. 5*c*, 5*d*, and 5*e*.

Subsequently, continuing the lifting of the tubular body 3 by way of the actuation of the electric motor 10, the translation of the tubular body 3 upward, as a consequence of the engagement of the bearing or pin 18 with the cylindrical helical slot 17 present on the lateral surface of the lower sleeve 13, causes the rotation, preferably through an angle of 180°, of the tubular body 3 about its own axis 4. This rotation causes the transition of the tip of the beveling present on the upper axial end 3*a* of the tubular body 3, from the side of the article 60 which is occupied by the pocket 60*b* of the heel arranged furthest from the end of the article 60 hooked by the pickup device 34 or by the handling device 28, to the opposite side occupied by the other pocket 60*a* which however has already been extroverted on the outer lateral surface of the tubular body 3, as illustrated in FIG. 6.

The rotation of the tubular body 3 about its own axis 4 causes the disengagement of the snap pin 24 from the seat 25, which it was occupying previously, and its engagement with the other seat 25 arranged in a diametrically opposite position on the lateral surface of the lower sleeve 13.

It should be noted that, by virtue of the engagement of the snap pin 24 with the corresponding seat 25, the new rotational position of the tubular body 3 is maintained.

At this point, by way of the actuation in the opposite direction of the pneumatic actuator 19, the bearing or pin 18 is disengaged from the cylindrical helical slot 17 present on the outer surface of the lower sleeve 13, as shown in FIGS. 7, 7*c*, 7*d*, 7*e*, so as to not obstruct the further lifting of the tubular body 3 performed again by the electric motor 10.

If the second actuation means 6 are made in the variation shown in FIG. 9, the rotation of the tubular body 3 about its own axis 4 through an angle of preset breadth, preferably of 180°, is actuated simply by way of the actuation of the electric motor 20.

The further lifting of the tubular body 3 causes the eversion of the pocket 60*b* of the heel i.e. of the pocket that is furthest from the end hooked by the pickup device 34 or by the handling device 28, on the outer lateral surface of the tubular body 3, as illustrated in FIG. 8. It should be noted that, since the tubular body 3 is rotated about its axis 4 through an angle of 180° with respect to the position at the start of operation, this pocket 60*b* exits from the opposite side of the upper axial end 3*a* of the tubular body 3 with respect to the tip of the beveling and therefore any possibility of sticking of the upper axial end 3*a* of the tubular body 3 with the article 60 is safely prevented.

The operation of the turning device then proceeds as described in the EP 2,250,307 B1 patent. Briefly, the eversion of the article 60 on the outer lateral surface of the tubular body 3 is optionally completed using the auxiliary sliding means 46 until the upper axial end 3*a* of the tubular body 3 is freed, over which the upper sleeve 43 is then fitted. The upper axial end 3*a* of the tubular body 3 is then hooked by the grip means 26 provided on such upper sleeve 43 and the upper sleeve 43 is then translated upward so as to perform the further lifting of the tubular body 3 with respect to the lower sleeve 13. This axial translational movement of the tubular body 3 with respect to the lower sleeve 13 causes the disengagement of the lower axial end 3*b* of the tubular body 3 from the lower sleeve 13.

At this point, the first axial pusher means 40 are lowered, and the lower sleeve 13 is also lowered by way of the actuation in the opposite direction of the electric motor 10 so as to free the region occupied by the pickup device 34 and by the handling device 28.

The pickup device 34 is then disengaged from the handling device 28 and moved away from the turning device.

The article 60 is then in the inside-out configuration, ready for closure by way of sewing or linking of its lower end, which is done in a way that is known per se, for example as described in the EP 2,250,307 B1 patent. It should be noted that, in order to execute the inversion of tubular articles in which the pockets have different positions about the axis of the article, the tubular body 3 can be engaged with the lower sleeve 13 in two or more positions that are variously oriented about its own axis 4 with respect to the lower sleeve 13. For this purpose, there are two or more holes 16, angularly mutually spaced apart about the axis 4, each engageable by the elastic lamina 15, proximate to the lower end 3*b* of the tubular body 3. As a consequence, there are two or more holes 45 proximate to the upper end 3*a* in order to allow the gripping of the tubular body 3 by the grip means 26.

In practice it has been found that the turning device according to the invention fully achieves the set aim in that, thanks to the possibility of rotating the tubular body about its own axis during the inversion operation and more precisely after or during the eversion of the pocket arranged on one side and before the eversion of the pocket arranged on the other side of the article, it effectively prevents the beveled tip of the tubular body from sticking in one of these pockets.

In this manner, the integrity of the articles is ensured, even in the inversion of articles that have pockets arranged on both sides of the article.

The turning device, thus conceived, is susceptible of numerous modifications and variations, all of which are within the scope of the appended claims. Moreover, all the details may be substituted by other, technically equivalent elements.

In practice the materials employed, and the dimensions, may be any according to requirements and to the state of the art.

The disclosures in Italian Patent Application No. 102015000070695 (UB2015A005413) from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A turning device having a tubular body for knitted tubular articles which comprises a main supporting structure which supports the tubular body arranged with its axis being vertical, said tubular body having an upper axial end beveled along a plane that is inclined with respect to its axis, first actuation means being provided which can be activated to perform a translation of said tubular body along its axis with respect to said main supporting structure, said tubular body being insertable, with its upper axial end, through an axial end of a tubular article in order to turn it inside out, and further comprising second actuation means which can be activated to rotate said tubular body about its axis, through an angle of predetermined breadth, with respect to said main supporting structure, wherein said tubular body is supported so that the tubular body can rotate about its axis, by a supporting element which is supported so that the tubular body can slide, along a direction that is parallel to the axis of said tubular body and further including said tubular body being connected coaxially by means of a lower axial end thereof, to a lower sleeve which is supported so that the lower sleeve can rotate about its own axis, and said second actuation means comprise a cylindrical helical slot extended on a lateral surface of said lower sleeve and a pin supported by said main supporting structure and engageable on command with said cylindrical helical slot upon the translation of said lower sleeve, together with said tubular body, along its axis with respect to said main supporting structure by the action of said first actuation means.

2. The device according to claim 1, wherein said tubular body is connected, detachably and integrally in rotation about its own axis, to said lower sleeve, said tubular body being engageable with said lower sleeve or disengageable from said lower sleeve by way of an axial sliding of said lower sleeve with respect to said tubular body or vice versa.

3. The device according to claim 1, further comprising elastic means supported by said lower sleeve and engageable with said tubular body or disengageable from said tubular body adjacent to its lower axial end.

4. The device according to claim 1, wherein said pin is engageable or disengageable on command with said cylindrical helical slot.

5. The device according to claim 1, wherein said cylindrical helical slot is extended on the lateral surface of said lower sleeve about the axis of said tubular body by halfway around the lateral surface of said lower sleeve.

6. The device according to claim 1, further comprising means for retaining said tubular body in preset rotational positions that are angularly mutually spaced around the axis of said tubular body.

7. The device according to claim 1, wherein said supporting element of the tubular body comprises a slider which is supported slideably by vertical guides fixed to said main supporting structure; said slider being movable on command along said vertical guides by the action of said first actuation means.

8. The device according to claim 7, wherein said second actuation means comprise an electric motor mounted on said slider and connected with its output shaft to a pinion which meshes with a ring gear which is fixed coaxially around said lower sleeve.

9. The device according to claim 1, further comprising a lower part, which comprises a lower portion of the main supporting structure which slideably supports said tubular body along its axis and said first actuation means, and an upper part, which comprises an upper portion of said main supporting structure which is provided with a means for gripping the upper axial end of said tubular body, between said lower part and said upper part there being an intermediate region at which means are arranged for supporting the tubular article to be turned inside out, which is hung at an axial end thereof and is arranged substantially vertically, said tubular body being insertable, upward from below, with its upper axial end, through said axial end of the tubular article which is hung from said supporting means after aspirating the tubular article through said upper axial end of the tubular body, for the eversion of the tubular article, retained by said supporting means, on an outer lateral surface of said tubular body, with progressive extraction of the tubular article from said upper axial end of the tubular body.

10. The device according to claim 9, wherein said means for supporting the tubular article to be turned inside out comprise a handling device provided with an annular body, arranged with its axis at a main vertical axis and supporting a plurality of spikes, which are arranged along an ideal cylindrical surface, the axis of which coincides with the axis of said body of the handling device, and are adapted to support the tubular article to be turned inside out hung at an axial end thereof; said tubular body being arrangeable or arranged with its axis at said main axis and being movable on command along said main axis at least partly by the action of said first actuation means.

11. The device according to claim 1, wherein the inside of said tubular body can be connected to pneumatic suction means via a telescopic tube which is connected in a lower region to said lower sleeve.

* * * * *